US009795276B2

(12) United States Patent
Park et al.

(10) Patent No.: US 9,795,276 B2
(45) Date of Patent: Oct. 24, 2017

(54) DISH WASHING MACHINE

(71) Applicant: SAMSUNG ELECTRONICS CO., LTD., Suwon-si, Gyeonggi-do (KR)

(72) Inventors: Dah We Park, Seoul (KR); Joo Hee Ryu, Goyang-si (KR); Jong Su Jeon, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/349,503

(22) Filed: Nov. 11, 2016

(65) Prior Publication Data

US 2017/0135554 A1 May 18, 2017

(30) Foreign Application Priority Data

Nov. 12, 2015 (KR) ..... 10-2015-0158596

(51) Int. Cl.

| | |
|---|---|
| ***A47L 15/50*** | (2006.01) |
| ***A47L 15/16*** | (2006.01) |
| ***A47L 15/22*** | (2006.01) |
| ***A47L 15/42*** | (2006.01) |

(Continued)

(52) U.S. Cl.

CPC ..... *A47L 15/506* (2013.01); *A47L 15/16* (2013.01); *A47L 15/22* (2013.01); *A47L 15/4221* (2013.01); *A47L 15/4225* (2013.01); *A47L 15/4257* (2013.01); *A47L 15/4285* (2013.01); *A47L 15/507* (2013.01); *A47B 46/005* (2013.01); *A47B 2088/901* (2017.01)

(58) Field of Classification Search

CPC .. A47L 15/506; A47L 15/4257; A47L 15/507; A47L 15/504; A47B 2088/901; A47B 46/005; A47B 96/07

See application file for complete search history.

(56) References Cited

U.S. PATENT DOCUMENTS 5,115,822 A * 5/1992 Nichols ..... A47L 15/506 134/135
5,971,513 A * 10/1999 Cassalia ..... A47L 15/506 312/272

(Continued)

FOREIGN PATENT DOCUMENTS

| | | |
|---|---|---|
| KR | 10-0220731 | 9/1999 |
| KR | 10-2004-0076668 | 9/2004 |
| KR | 10-0854998 | 8/2008 |

OTHER PUBLICATIONS

International Search Report dated Feb. 15, 2017 from International Patent Application No. PCT/KR2016/013003, 3 pages.

*Primary Examiner* — Daniel J Rohrhoff
(74) *Attorney, Agent, or Firm* — Staas & Halsey LLP

(57) ABSTRACT

The inconvenience associated with using a lower basket of a dish washing machine is reduced or eliminated by a dish washing machine which includes a washing tub with an open front, a basket configured to be inserted in or drawn out from the washing tub through the open front of the washing tub, a door which opens or closes the open front of the washing tub, at least one guide rail for mounting the basket on the door when the basket is drawn out from the washing tub while the door is open, and a lifting device which guides the guide rail to move between a raised position and a lowered position of the guide rail.

20 Claims, 26 Drawing Sheets

(51) Int. Cl.
*A47B 46/00* (2006.01)
*A47B 88/90* (2017.01)

(56) References Cited

U.S. PATENT DOCUMENTS

| | | | | |
|---|---|---|---|---|
| 6,247,771 | B1 * | 6/2001 | Miller | A47L 15/506 312/272 |
| 2004/0163687 | A1 * | 8/2004 | Son | A47L 15/506 134/58 D |
| 2008/0018215 | A1 * | 1/2008 | Carden | F25D 25/025 312/404 |
| 2008/0129168 | A1 * | 6/2008 | Banta | A47L 15/506 312/333 |
| 2010/0045152 | A1 * | 2/2010 | Bond | A47L 15/506 312/319.1 |
| 2012/0074080 | A1 * | 3/2012 | Garcia | A47B 46/005 211/41.9 |
| 2016/0309982 | A1 * | 10/2016 | Gerstner | A47L 15/506 |

* cited by examiner ( a )

( b )

DISH WASHING MACHINE

CROSS-REFERENCE TO RELATED APPLICATIONS

This application claims the priority benefit of Korean Patent Application No. 10-2015-0158596, filed on Nov. 12, 2015, in the Korean Intellectual Property Office, the disclosure of which is incorporated herein by reference in its entirety.

BACKGROUND

1. Field

Embodiments of the disclosure relate to a dish washing machine, and more particularly, to a dish washing machine which removes inconvenience of using a lower basket.

2. Description of the Related Art

Generally, a dish washing machine is an apparatus which jets washing water at a high pressure to dishes to wash, and generally a preliminary washing operation, a main washing operation, a rinsing operation, and a drying operation are performed. In the preliminary washing operation, garbage on dishes is removed by jetting washing water without a detergent. In the main washing operation, a detergent is added by a detergent supply device simultaneously with jetting washing water for washing dishes.

Meanwhile, baskets for loading dishes to be washed are installed at the top and bottom in a dish washing machine, and an upper basket and a lower basket may be independently inserted into or drawn out from the dish washing machine.

Generally, the lower basket of the dish washing machine is large and heavy and used for washing a large amount of dishes. Here, there is an inconvenience for a user to repeatedly fold and unfold his or her back by about 90 degrees to load and unload dishes.

SUMMARY

Additional aspects and/or advantages will be set forth in part in the description which follows and, in part, will be apparent from the description, or may be learned by practice of the disclosure.

Therefore, it is an aspect of the disclosure to provide a dish washing machine including a lifting device for moving a lower basket up and down to remove inconvenience of using the lower basket of the dish washing machine.

It is another aspect of the disclosure to provide a dish washing machine including an improved lifting device that does not invade a washing space.

It is still another aspect of the disclosure to provide a dish washing machine which reduces garbage blockages which may occur at a lifting device during washing and draining.

Additional aspects of the disclosure will be set forth in part in the description which follows and, in part, will be apparent from the description, or may be learned by practice of the disclosure.

In accordance with an aspect of the disclosure, a dish washing machine may include a washing tub with an open front, a basket configured to be inserted into or drawn out from the washing tub through the open front of the washing tub, a door configured to open or close the open front of the washing tub, at least one guide rail configured to mount the basket on the door when the basket is drawn out from the washing tub while the door is open, and a lifting device configured to raise and lower the at least one guide rail between a raised position and a lowered position respectively.

The lifting device may be enclosed inside the door when the at least one guide rail is in the lowered position and may be exposed outside the door when the at least one guide rail is in the raised position.

The lifting device may include at least one link member pivotably provided at the door.

The at least one link member may include a pair of link members arranged to at least partially overlap each other when the at least one guide rail is in the lowered position.

The lifting device may further include a link connecting member connecting the pair of link members, and the link connecting member may be accommodated in an inner space provided between the pair of link members arranged to overlap each other.

The lifting device may include at least one elastic member configured to provide an elastic restoring force in a direction in which the at least one guide rail moves upward.

The lifting device may further include a pair of link members arranged parallel to each other and configured to support the at least one guide rail, and the at least one elastic member may be disposed between the pair of link members.

The door may further include at least one slowing device configured to reduce at least one of a speed at which the at least one guide rail is raised and a speed at which the at least one guide rail is lowered.

The slowing device may include an operating body configured to reciprocate and to apply force to the lifting device and a damping spring may provide an elastic restoring a force to the operating body.

The at least one link member may include a rotation stopper configured to limit a rotation angle of the at least one link member.

The basket may include a plurality of rollers at a bottom thereof, and the at least one guide rail may include a rail groove on which the plurality of rollers are mounted.

The at least one guide rail may further include a roller stopper configured to limit a movement of the plurality of rollers.

The at least one guide rail may include a pair of guide rails arranged paralled to one another.

The dish washing machine may further include a cover member configured to cover the lifting device when the at least one guide rail is in a lowered position.

The cover member may include a sealing portion configured to prevent washing water from permeating the lifting device when the cover member covers the lifting device.

In accordance with an aspect of the disclosure, a dish washing machine may include a washing tub having an open portion, a basket and a door configured to open or close the open portion of the washing tub, the door may include a front surface that faces away from the open portion of the washing tub when the door is closed, and a rear surface that faces toward the open portion of the washing tub when the door is closed, wherein a distance between at least a portion of the rear surface of the door and the front surface of the door is changeable so as to raise or lower the basket is drawn out from the washing tub.

The door may include at least one guide rail disposed on the rear surface of the door and configured to guide the basket when the basket is drawn out from the washing tub and a lifting device configured to raise and lower the at least one guide rail.

The lifting device may be accommodated between the front surface and the rear surface of the door when the at least one guide rail is in a lowered position.

The door may further include a cover member configured to cover the lifting device when the at least one guide rail is in the lowered position.

The lifting device may further include a damper disposed below the at least one guide rail and configured to provide a damping force in a direction for reducing a movement speed of the at least one guide rail.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
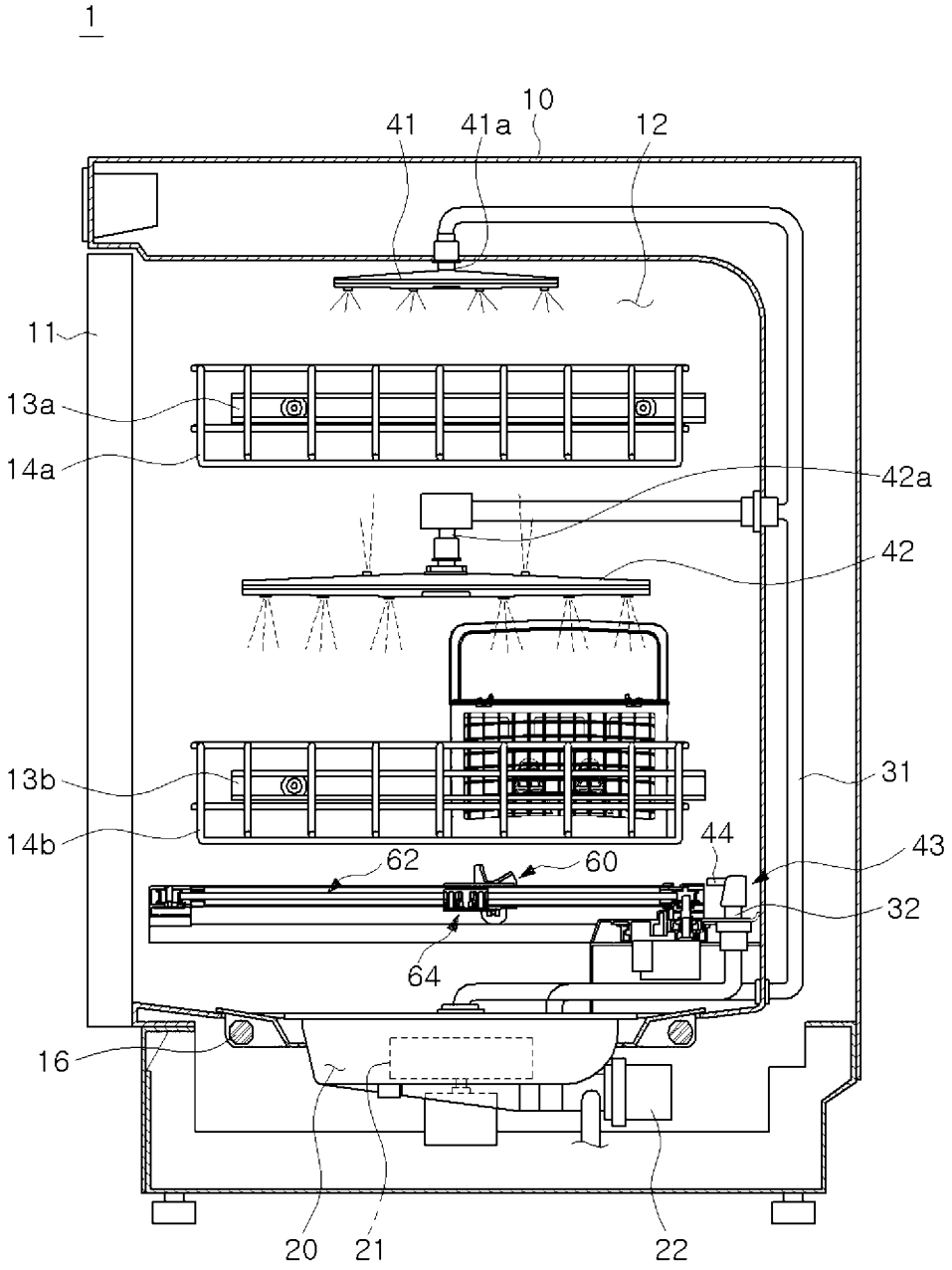
FIG. 1 is a cross-sectional view of a dish washing machine in accordance with an embodiment of the disclosure.

Reference will now be made in detail to example embodiments which are illustrated in the accompanying drawings, wherein like reference numerals refer to like elements throughout. The embodiments are described below to explain the disclosure by referring to the figures.

Hereinafter, exemplary embodiments of the disclosure will be described in detail. Meanwhile, the terms "front end", "rear end", "top", "bottom", "top end", "bottom end", etc. used herein are defined based on the drawings, and shapes and positions of components are not limited thereto.

FIG. 1 is a cross-sectional view of a dish washing machine in accordance with an embodiment of the disclosure.

A dish washing machine 1 may include a body 10 which forms an exterior, a washing tub 12 provided in the body 10, baskets 14*a* and 14*b* provided in the washing tub 12 to store dishes, a sump 20 which collects and stores washing water, and jet units 41, 42, and 43 which jet washing water.

The washing tub 12 is formed in an approximate box shape and has an open front for putting in or taking out dishes. The open front of the washing tub 12 may be opened and closed by a door 11. The doors 11 may be pivotably coupled with the body 10.

The baskets 14*a* and 14*b* may include an upper basket 14*a* and a lower basket 14*b*. The upper basket 14*a* may be supported by an upper rail 13*a*, and the lower basket 14*b* may be supported by a lower rail 13*b*. The upper basket 14*a* and the lower basket 14*b* may be configured to be slidable forward and backward in the washing tub 12 due to the upper rail 13*a* and the lower rail 13*b*.

Water stored in the sump 20 may include a washing pump 21 which pumps the stored water to the jet units 41, 42, and 43. Washing water pumped by the washing pump 21 may be supplied to a first jet unit 41 and a second jet unit 42 through a first supply pipe 31 and to a third jet unit 43 through a second supply pipe 32.

Also, a heater 16 for heating washing water and a drain pump 22 for draining washing water may be provided at a bottom of the washing tub 12.

Meanwhile, as shown in FIG. 1, the first jet unit 41 may be provided above the upper basket 14*a*, the second jet unit 42 may be provided between the upper basket and the lower basket 14*b*, and the third jet unit 43 may be provided below the lower basket 14*b*.

Also, the first jet unit 41 may be configured to rotate about a rotating shaft 41*a*, and the second jet unit 42 may be configured to rotate about a rotating shaft 42*a*.

The first jet unit 41 may jet washing water toward dishes stored in the upper basket 14*a*, and the second jet unit 42 may jet washing water toward dishes stored in the lower basket 14*b*.

Meanwhile, the third jet unit 43 may be provided at one side of the washing tub 12, unlike the first jet unit 41 and the second jet unit 42. The third jet unit 43 may jet washing water in an approximate horizontal direction. Accordingly, the washing water jetted by the third jet unit 43 may be not directly jetted toward the dishes.

The third jet unit 43 may include a nozzle 44 which jets washing water. The nozzles 44 may be arranged in a row, at a certain regular spacing approximately from one side of the washing tub 12 to the opposite side.

The washing water horizontally jetted from the nozzle 44 of the third jet unit 43 may be deflected by a deflecting assembly 60 disposed in the washing tub 12 and may move toward dishes stored in the lower basket 14*b*. The deflecting assembly 60 is configured to be fastened to a jet rail 62 by a holder 64 and to be movable along the jet rail 62.

Figure 2:
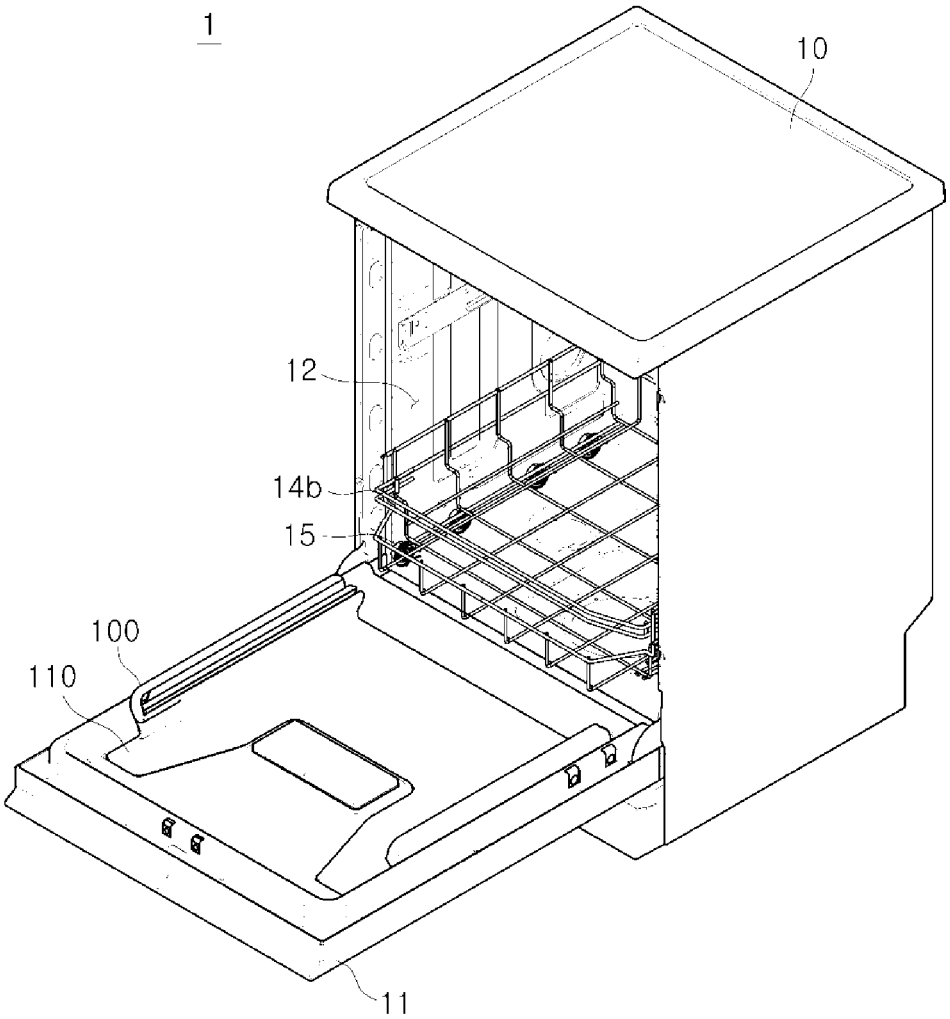
FIG. 2 is a view illustrating a state in which a door of the dish washing machine is opened in accordance with an embodiment of the disclosure.
Figure 3:
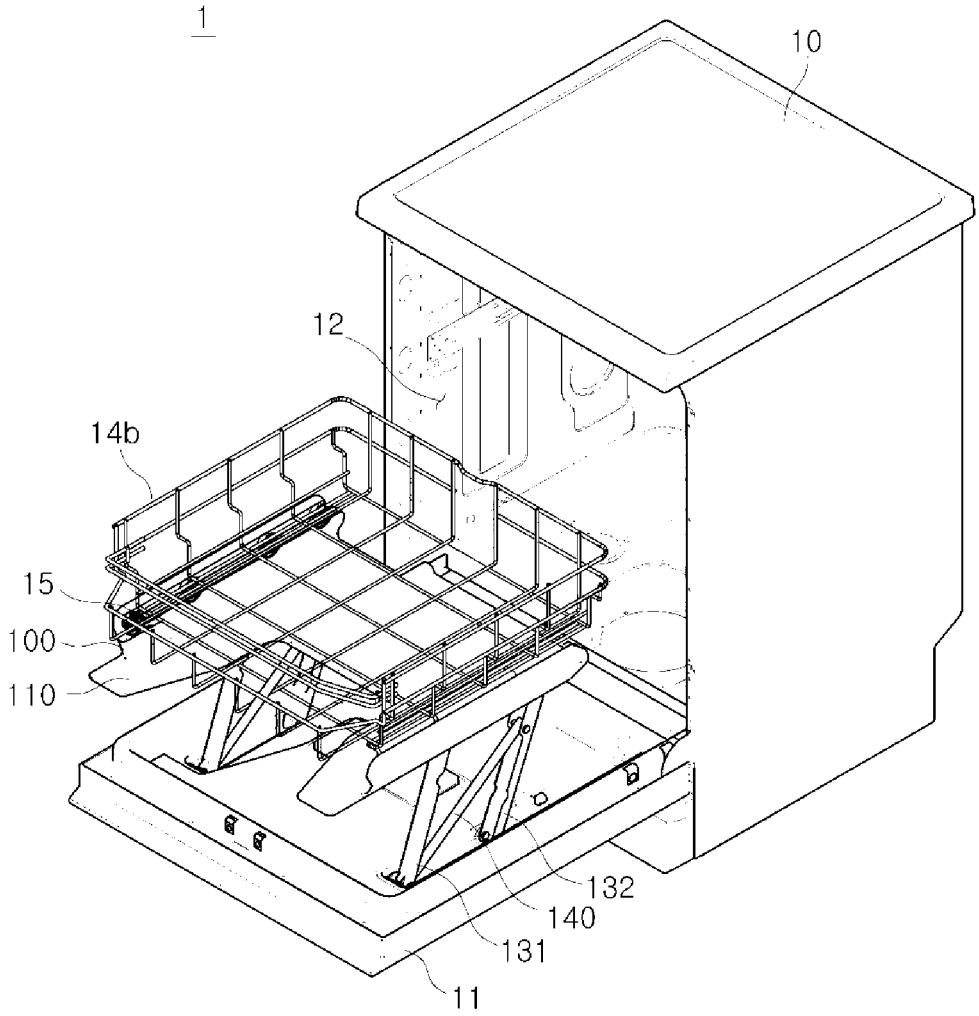
FIG. 3 is a view illustrating a state in which a guide rail of the dish washing machine moves upward in accordance with an embodiment of the disclosure.
Figure 4:
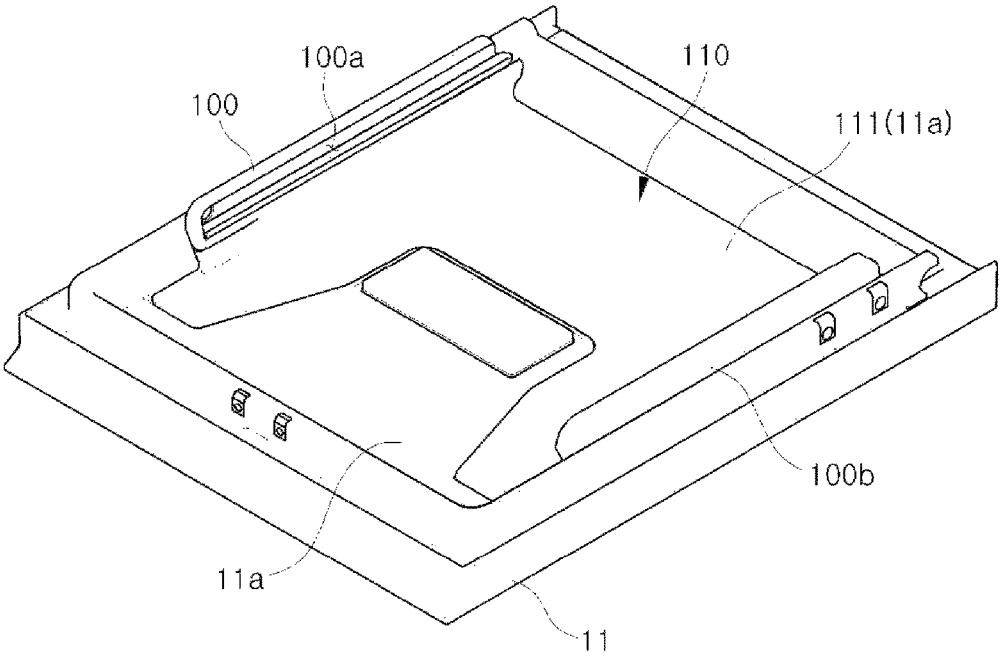
FIG. 4 is a view illustrating the door of the dish washing in accordance with an embodiment of the disclosure.
Figure 5:
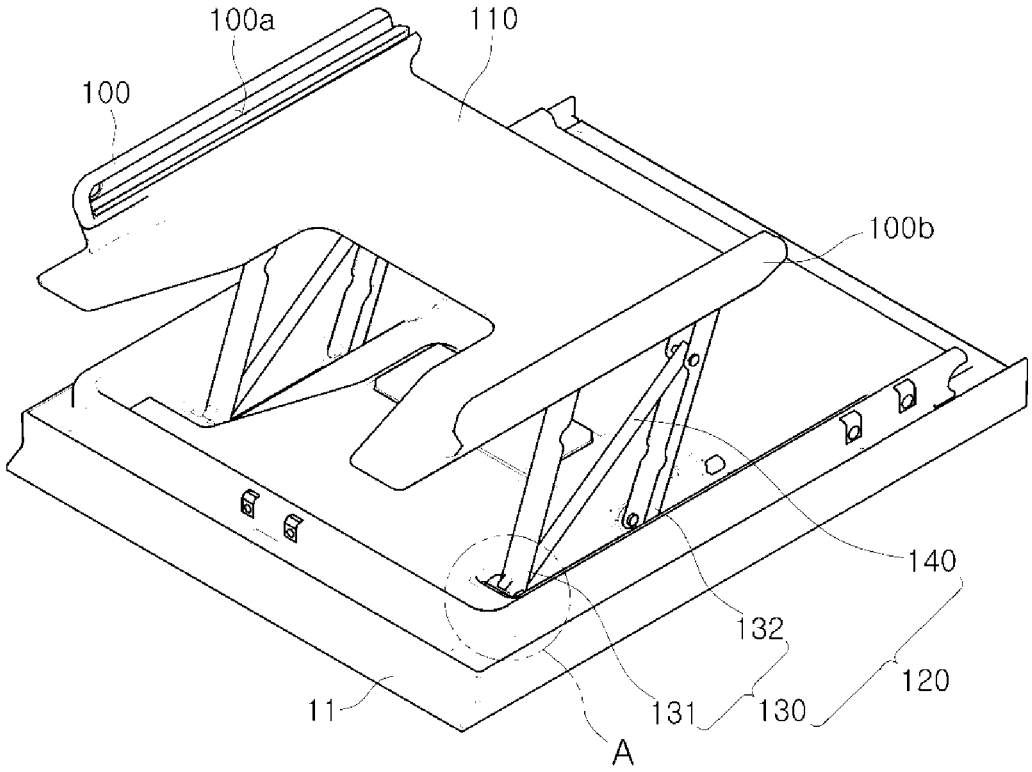
FIG. 5 is a view illustrating a state in which the guide rail of the dish washing is moved upward in accordance with an embodiment of the disclosure.

FIG. 2 is a view illustrating a state in which the door of the dish washing machine in accordance with an embodiment of the disclosure is open. FIG. 3 is a view illustrating a state in which a guide rail of the dish washing machine in accordance with an embodiment of the disclosure moves upward. FIG. 4 is a view illustrating the door of the dish washing machine in accordance with an embodiment of the disclosure. FIG. 5 is a view illustrating a state in which the guide rail of the dish washing machine in accordance with an embodiment of the disclosure is moved upward.

As described above, baskets may include an upper basket and a lower basket. Hereinafter, a basket refers to a lower basket.

As is apparent from FIGS. 2 and 3, the dish washing machine 1 may include the body 10 with an open front, the washing tub 12 provided in the body 10, the basket 14*b* provided in the washing tub 12 to store dishes, and the door 11 which opens and closes the open front of the body 10.

The door 11 may be configured to be pivotable about a rotating shaft provided at the bottom. A user may open the door 11 by pulling a handle (not shown) provided on the outside of the door 11. The door 11 may become open while a top swings downward.

The door 11 may include at least one guide rail 100 which allows the basket 14*b* to be mounted on a rear surface 11*a* of the door 11 when the basket 14*b* is drawn out from the washing tub 12 while the door 11 is open and a lifting device 120 which lifts the basket 14*b* mounted on the rear surface 11*a* of the door 11 using the guide rail 100. The lifting device 120 may guide movement of the guide rail 100 to allow the guide rail 100 to move between a raised position and a lowered position.

When a cover member 110 is installed at the door 11, the rear surface 111 of the cover member 110 may form at least a part of the rear surface 11*a* of the door 11.

As shown in FIGS. 2 and 4, when the lifting device 120 is in a lowered state, the lifting device 120 may be enclosed inside the door 11 and not exposed to outside. That is, when the lifting device 120 is enclosed inside the door 11, the lifting device may be covered by the cover member 110 not to be exposed to outside. Accordingly, when the door 11 is closed, the lifting device 120 may be separated from a washing space by the cover member 110. Accordingly, a dish washing machine in accordance with the concept of the disclosure may provide a lifting device having a space separate from a washing tub and a structure with no interference when the door 11 is closed. Through this, the lifting device 120 does not invade a washing space and washing water or garbage may be prevented from contaminating the lifting device 120. Also, the lifting device 120 below the cover member is not exposed to outside, and aesthetics improve.

As shown in FIG. 3, the basket 14*b* may be coupled with the guide rail 100. Also, when a user lifts the basket 14*b* coupled with the guide rail 100, the basket 14*b* may be moved upward with the guide rail 100 by the lifting device 120. The user may bend his or her back a little bit to load or unload dishes while the basket 14*b* is in a raised state.

The basket 14*b* may include a plurality of rollers 15 at the bottom thereof. The basket 14*b* may smoothly move into or out of the washing tub 12 due to the rollers 15. As shown in FIGS. 2 and 3, the rollers 15 may be arranged in two rows on both sides at the bottom of the basket 14*b*, and the number of rollers 15 in each of the rows may be identical. The basket 14*b* may be stably supported by the rollers 15 arranged as such.

As shown in FIG. 4, the door 11 may include at least one guide rail 100 which guides the basket 14*b* outward from a washing space, the lifting device 120 which moves the guide rail 100 upward, and the cover member 110 which covers the lifting device 120 when the lifting device 120 is enclosed inside the door 11. The guide rail 100 is provided in a shape corresponding to the rollers 15 of the basket 14*b*. The guide rail 100 defines a movement path on which the rollers 15 of the basket 14*b* roll and prevents the rollers 15 from deviating from the guide rail 100. For this, the guide rail 100 may include a rail groove 100*a* which forms a path on which the rollers 15 roll and a guide wall 100*b* which controls the rollers 15 not to move in a direction perpendicular to the movement path of the rollers 15, that is, a width direction. In the embodiment, the guide wall 100*b* is formed at a position for controlling the outer side of the rollers 15. However, the same effect may be provided even when the guide wall 100*b* is formed at a position for controlling the inner side of the rollers 15.

Figure 25:
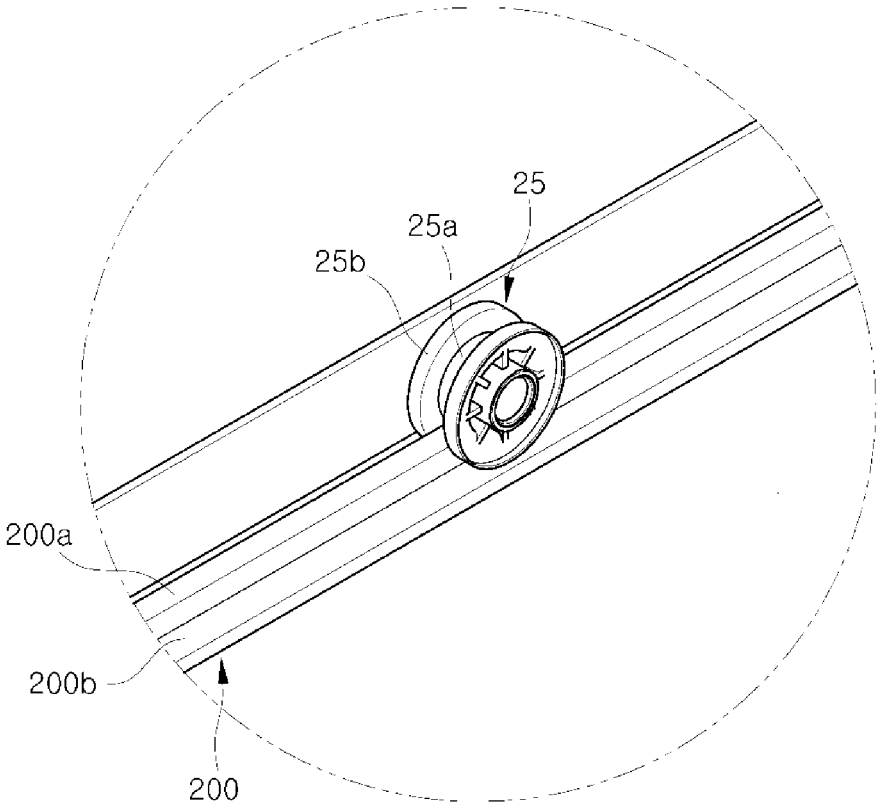
FIG. 25 is a view of a roller and a guide rail of the dish washing machine in accordance with an embodiment of the disclosure.
Figure 26:
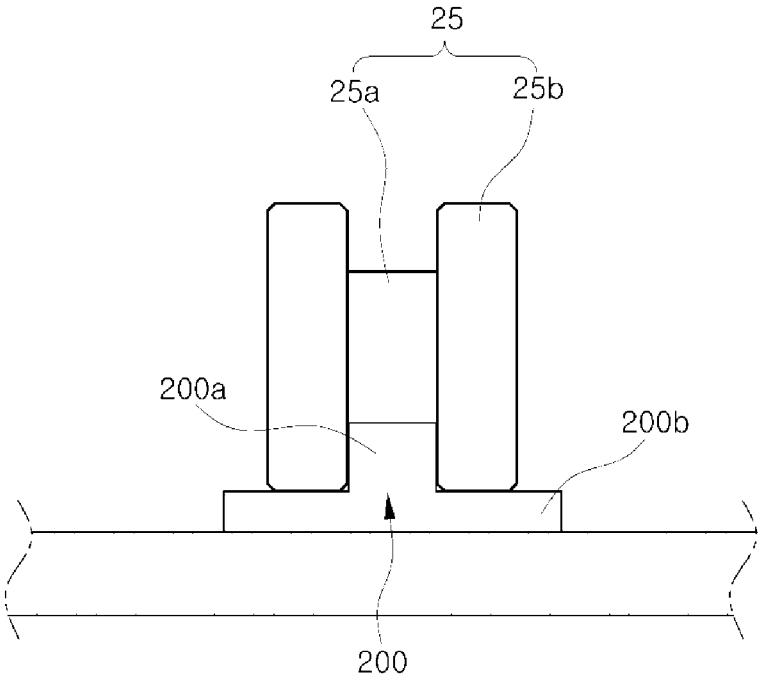
FIG. 26 is a cross-sectional view of the roller and the guide rail of FIG. 25.

As a modified structure thereof, an outer circumferential surface of a roller 25 is caved in toward a rotation center of the roller 25 and a guide rail 200 is formed in a protruding rib shape not to allow the roller 25 to lean left or right while the roller 25 is rolling (refer to FIGS. 25 and 26).

Also, to stably support the basket 14*b*, a pair of guide rails 100 may be configured corresponding to the rollers 15 on left and right of the basket 14*b*. However, even though the rollers 15 are arranged in two rows, on which side the guide rail 100 is disposed is immaterial, whether left or right. Also, when the pair of guide rails 100 are disposed on both sides, while it is unnecessary that the guide rails 100 have the same shapes, at either of the guide rails 100, there may be no guide wall 100*b* or rail groove 100*a*.

Figure 6:
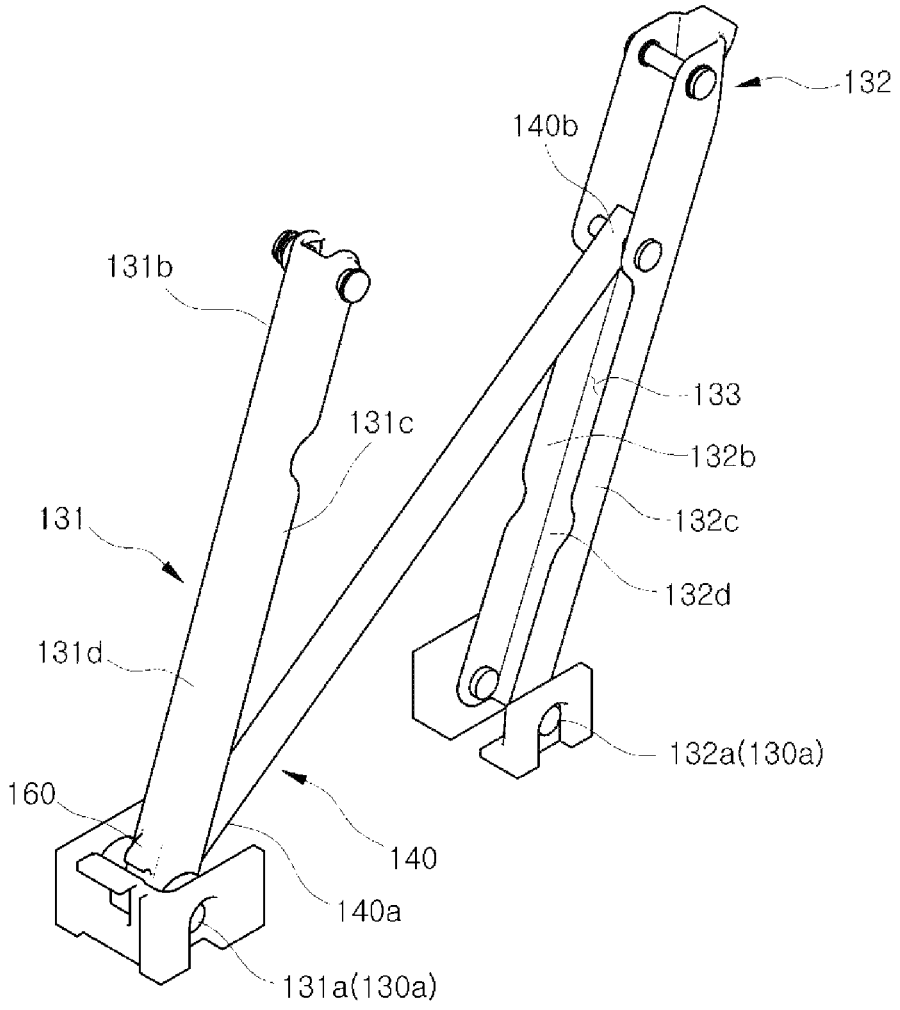
FIG. 6 is a view illustrating a link member and a link connecting member of the dish washing machine in accordance with an embodiment of the disclosure.
Figure 7:
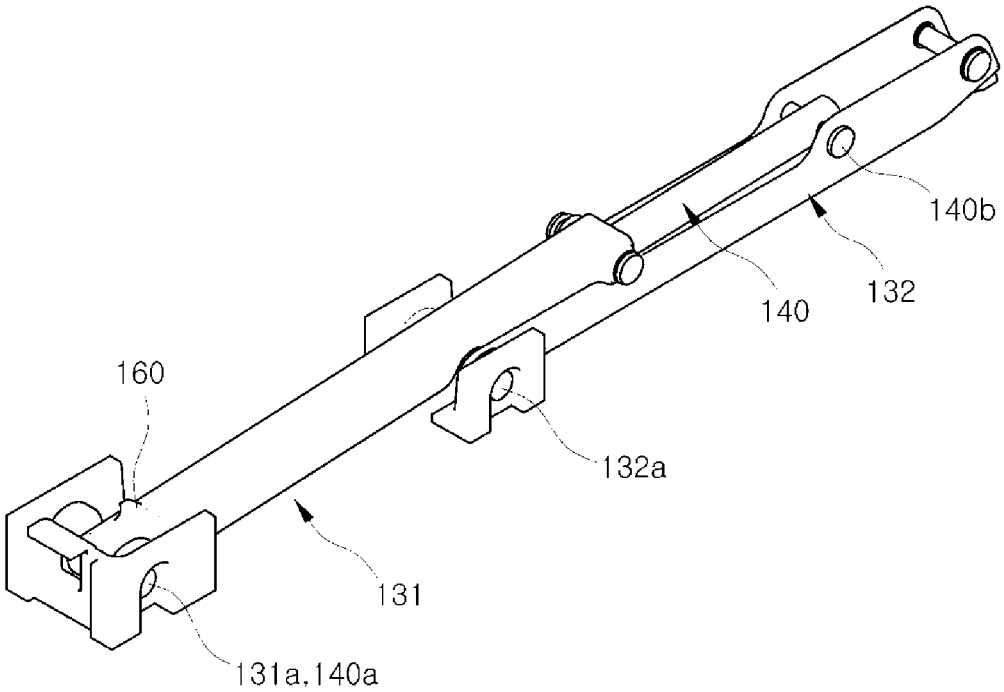
FIG. 7 is a view illustrating a state in which the link member and the link connecting member of the dish washing machine are arranged to overlap each other in accordance with an embodiment of the disclosure.

As shown in FIGS. 5 to 7, the lifting device 120 may include a link member 130 which supports the guide rail 100 when the guide rail 100 is separated from the rear surface of the door. A pivoting portion 130*a* may be provided at one end of the link member 130, and the link member 130 may pivot about the pivoting portion 130*a* in such a way that the guide rail 100 may move upward or downward. When the basket 14*b* is mounted on the guide rail 100, the guide rail 100 and the basket 14*b* may move upward or downward together.

When the guide rail 100 is in a lowered state, the link member 130 may be disposed parallel to a longitudinal direction of the door 11, that is, a direction in which the rollers 15 of the basket 14*b* move and be enclosed inside the door 11. When the guide rail 100 moves upward, the link member 130 pivots about the pivoting portion 130*a* and is exposed outside the door. That is, depending on a pivoting angle of the link member 130, how high the guide rail 100 moves may become different.

A pair of such link members 130 may be provided at one guide rail 100. In this case, the pair of link members 130 may include a first link member 131 and a second link member 132. Each of the link members 131 and 132 may be arranged in a row parallel to each other below the guide rail 100, and the first link member 131 and the second link member 132 may be arranged to at least partially overlap with each other.

Also, the link member 130 may be provided in a shape with a space therein. For example, the first link member 131 may include a pair of side frames 131*b* and 131*c* which face each other and a connecting frame 131*d* which is connected to one of the pair of side frames 131*b* and 131*c* to form a cross section of the first link member 131 in an open rectangle shape. Similarly, the second link member 132 may include a pair of side frames 132*b* and 132*c* which face each other and a connecting frame 132*d* which is connected to one of the pair of side frames 132*b* and 132*c* to form a cross section of the second link member 132 in an open rectangle shape.

Here, the connecting frames 131*d* and 132*d* of the pair of link members 131 and 132 are allowed to be arranged in a direction far from each other in such a way that the pair of side frames of one of the link members are disposed between the pair of side frames of the other link member when the guide rail 100 is enclosed inside the door. As described above, as the link members 131 and 132 overlap each other, an inner space 133 of the link member which is defined by one side frame 131*b* and the connecting frame 131*d* of the one link member and one side frame 132*c* of the other link member 132 may be formed, and a link connecting member 140 may be disposed in the inner space 133 as follows.

The link connecting member 140 may be disposed to connect the first link member 131 with the second link member 132. Also, in order not to interfere with pivoting operations of the link members 131 and 132, one end 140*a* of the link connecting member 140 is pivotably coupled with the first link member 131, and another end 140*b* of the link connecting member 140 is pivotably coupled with the second link member 132. Here, the one end 140*a* of the link connecting member 140 coupled with the link member 131 may be configured to have the same rotation shaft with the pivoting portion 131*a* of the link member 131. As described above, while the guide rail 100 is enclosed inside the door, the inner space 133 is formed by the pair of link members 131 and 132, and the link connecting member 140 is disposed in the inner space 133 and surrounded by the pair of link members 131 and 132. As described above, volume occupied by the lifting device 120 may be minimized.

The link connecting member 140 may be configured as an elastic body such as a spring. Through this configuration, force necessary for lifting the guide rail 100 may be reduced.

Hereinafter, an example in which the link connecting member 140 is formed as a spring will be described. When the guide rail 100 is in a lowered state, the pair of link members 131 and 132 and the spring may be arranged parallel to the door 11. Here, the spring is in a state in which length thereof is stretched, that is, in a biased state. When the guide rail 100 starts moving upward, distance between a connecting point between the spring and the first link member 131 and a connecting point between the second link member 132 and the spring becomes shorter. That is, the length of the spring becomes gradually shorter. Here, elastic restoring force of the spring acts, and the force is in a direction of lifting the guide rail 100. Particularly, when the basket 14*b* on which dishes are loaded is mounted on the guide rail 100, the user may lift the basket 14*b* and the guide rail 100 using small force. To further reduce force necessary for lifting the guide rail 100, the number, elastic coefficient, or length of such springs may be changed. However, when the elastic force of the spring becomes too strong, the guide rail 100 is allowed to rapidly move upward, dishes loaded on the basket 14*b* mounted on the guide rail 100 may be shocked and damaged or separated from the basket 14*b*.

Figure 8:
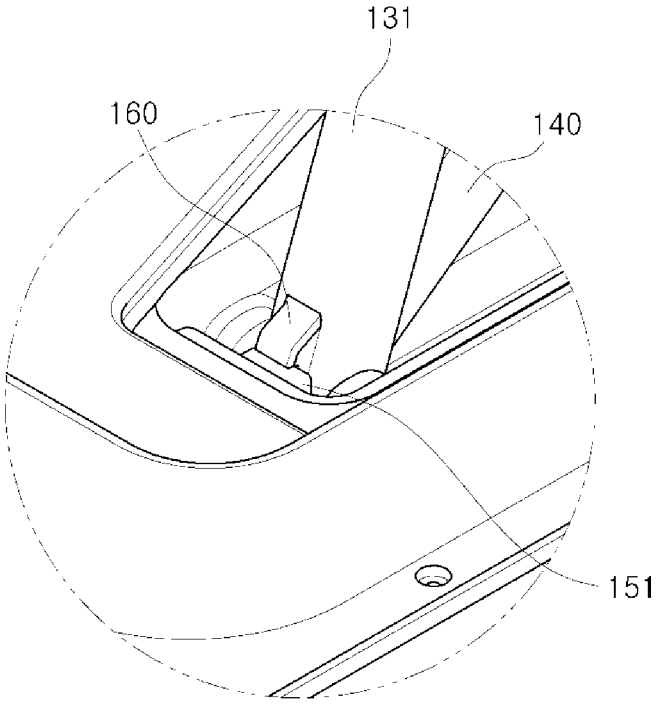
FIG. 8 is an enlarged view of a part A of FIG. 5.
Figure 9:
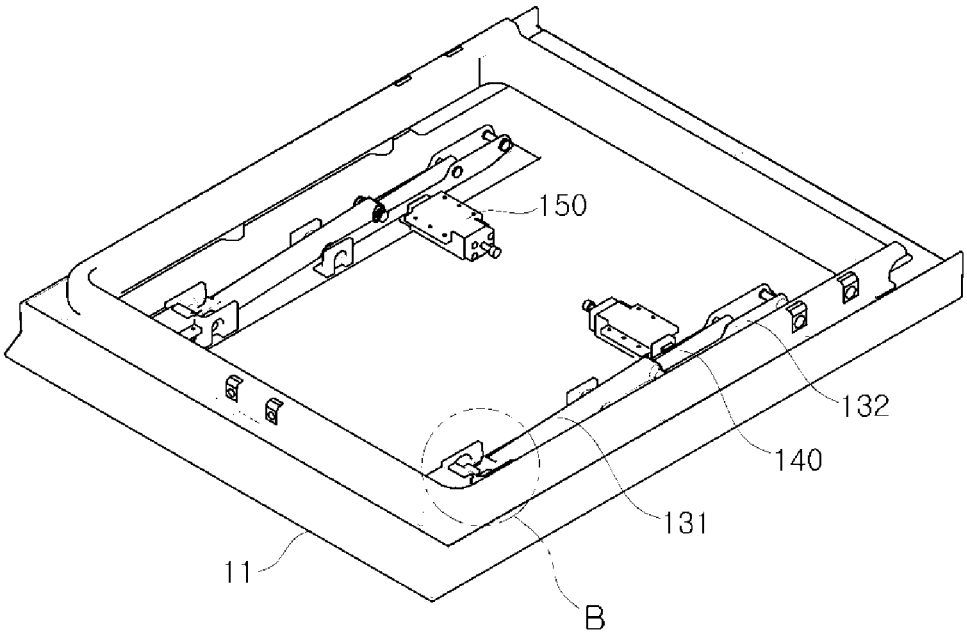
FIG. 9 is a view illustrating the inside of the door of the dish washing machine in accordance with an embodiment of the disclosure.
Figure 10:
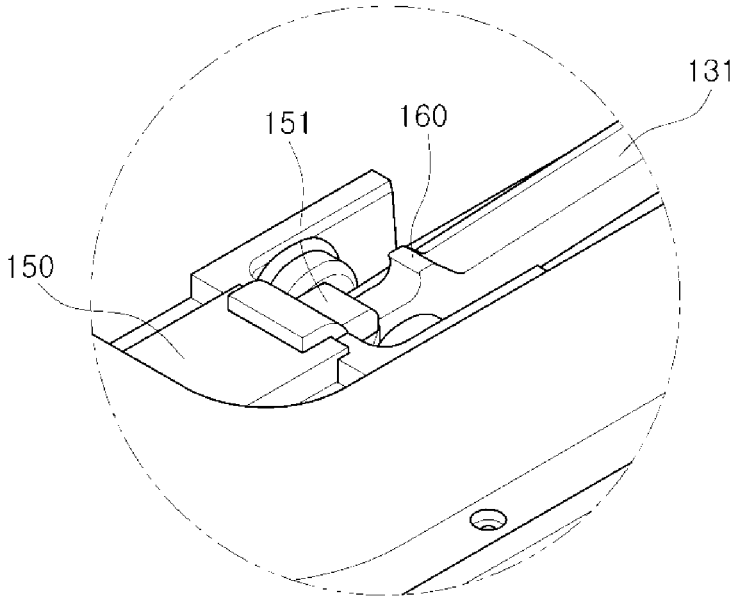
FIG. 10 is an enlarged view illustrating a part B of FIG. 9.

FIG. 8 is an enlarged view of a part A of FIG. 5. FIG. 9 is a view illustrating the inside of the door of the dish washing machine in accordance with an embodiment of the disclosure. FIG. 10 is an enlarged view illustrating a part B of FIG. 9.

The lifting device 120 may include a rotation stopper 160 which restricts the link member 131 from rotating by a certain angle or more. Limiting the rotation angle of the link member 131 is to limit a maximum raised height of the guide rail 100. This helps the basket 14*b* mounted on the guide rail 100 to move up to an optimal height for a user to comfortably and stably load dishes. The lifting device 120 of the dish washing machine in accordance with the embodiment may include a slowing device 150 which cooperates with the rotation stopper 160. Before describing an operation of the rotation stopper 160, the slowing device 150 will be described first.

Figure 11:
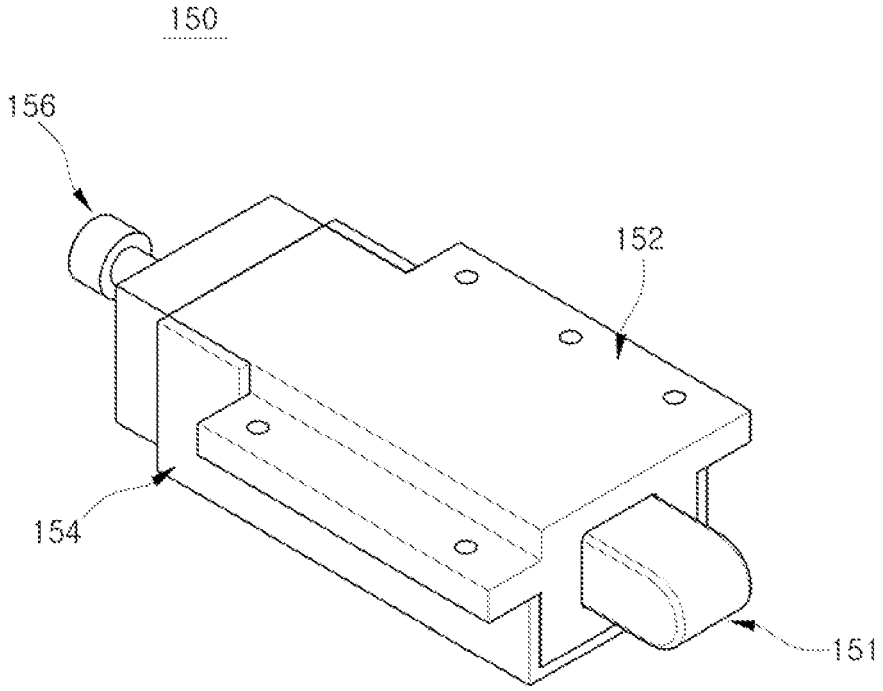
FIG. 11 is a view illustrating the slowing device of the dish washing machine in accordance with an embodiment of the disclosure.
Figure 12:
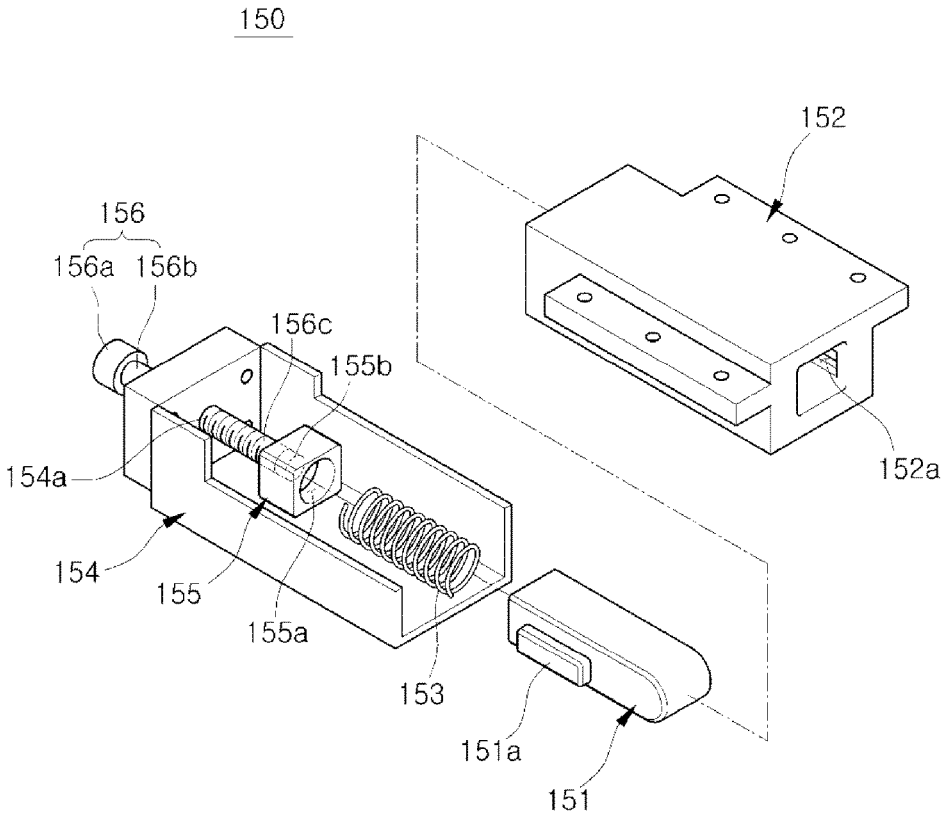
FIG. 12 is an exploded perspective view of the slowing device shown in FIG. 11.

FIG. 11 is a view illustrating the slowing device of the dish washing machine in accordance with an embodiment of the disclosure. FIG. 12 is an exploded perspective view of the slowing device shown in FIG. 11.

The lifting device 120 may include at least one slowing device 150 for reducing moving-up speed or moving-down speed of the guide rail 100. That is, the slowing device 150 performs a function of preventing a shock from being applied to dishes loaded on the basket 14*b* by slowing speed of the guide rail 100 before the guide rail 100 on which the basket 14*b* is mounted stops at a highest position or a lowest position.

As shown in FIGS. 11 and 12, the slowing device 150 may include an operating body 151, a body case 152 which accommodates at least a part of the operating body 151, a damping spring 153 which provides an elastic restoring force to the operating body 151, and a housing 154. Sliding protrusions 151*a* may be provided on both sides of the operating body 151, and sliding grooves 152*a* engaged with the sliding protrusions 151*a* may be provided at the body case 152. The sliding grooves 152*a* may be provided on both inner sides of the body case 152 along a longitudinal direction thereof. Accordingly, the operating body 151 may move forward and backward in the body case 152 by as much as a length of the body case 152. Here, to prevent the operating body 151 from deviating from the body case 152 through an open front portion of the body case 152, the sliding groove 152*a* may not be formed around the front portion of the body case 152 to restrict a movement range of the operating body 151.

The body case 152 in which the operating body 151 is inserted may be mounted in the housing 154. Here, the damping spring 153 is provided between the operating body 151 and the housing 154. Accordingly, a force greater than an elastic force of the damping spring 153 is necessary to move the operating body 151 backward. When a force is applied to the operating body 151, the operating body 151 moves backward and is inserted in the body case 152. When the force becomes identical to the elastic force of the damping spring 153, the operating body 151 does not move backward. When the force applied to the operating body 151 is removed, the operating body 151 moves forward again and protrudes due to the elastic restoring force of the damping spring 153. Accordingly, damping force provided by the operating body 151 is determined in accordance with a length by which the damping spring 153 is compressed. Here, in the embodiment, the slowing device 150 may include a structure capable of changing the length by which the damping spring 153 is compressed.

As shown in FIG. 12, a support 155 disposed opposite the operating body 151 with interposing the damping spring 153 therebetween and a damping control tab 156 which controls position of the support 155 along a movement direction of the operating body 151 are mounted in the housing 154 of the slowing device 150. A recess 155*a* which accommodates one end of the damping spring 153 and a screw hole 155*b* for being coupled with the damping control tab 156 are formed at the support 155. The damping control tab 156 is inserted in a through hole 154*a* formed at the housing 154 and is rotatably mounted on the housing 154. The damping control tab 156 may include a knob 156*a* which is a part gripped when the damping control tab 156 is rotated and a stem 156*b* which extends from the knob 156*a* and passes through the housing 154. A screw portion 156*c* with a screw thread formed thereon is formed at one end of the stem 156*b* to be coupled with the screw hole 155*b* of the support 155.

Meanwhile, the support 155 may be provided in an approximate rectangular parallelepiped shape. At least one surface of the support 155 is allowed to come into contact with an inner surface of the housing 154 in such a way that the support 155 does not rotate while the damping control tab 156 is rotated. Accordingly, when the knob 156*a* of the damping control tab 156 is gripped and rotated, the stem 156*b* rotates in such a way that a position of the support 155 screw-coupled with the stem 156*b* may be moved forward or backward. Accordingly, a distance between the support 155 and the operating body 151 becomes shorter or longer, and a length of the damping spring 153 disposed therebetween becomes shorter or longer. As the length of the damping spring 153 becomes shorter, since a force of biasing the operating body 151 toward a front of the body case 152 becomes greater, a damping force provided by the slowing device 150 becomes greater.

Figure 13:
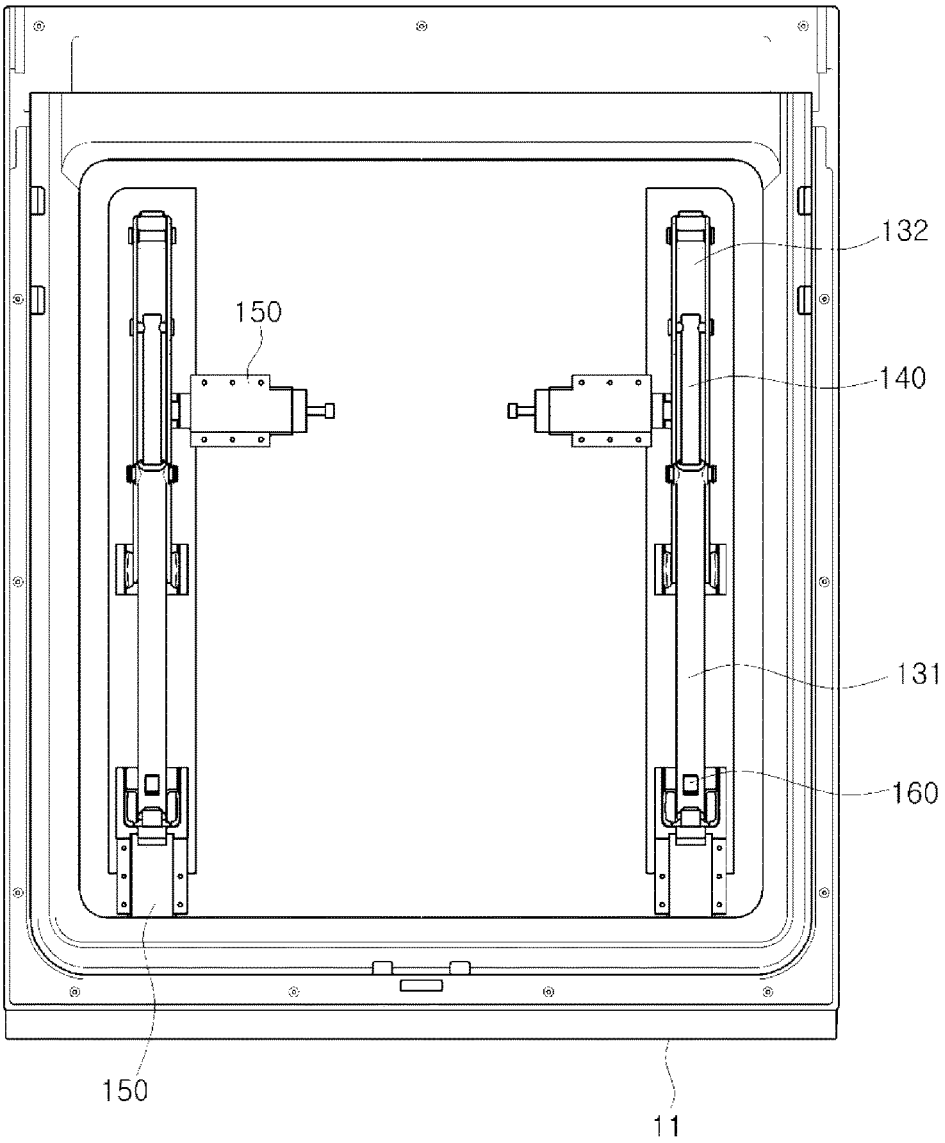
FIG. 13 is a plan view illustrating the inside of the door of the dish washing machine in accordance with an embodiment of the disclosure.
Figure 14:
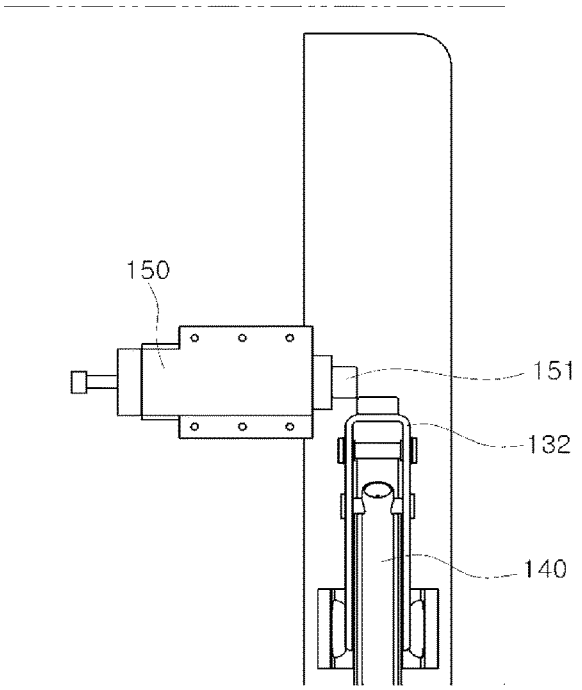
FIG. 14 is a view illustrating an operation of the slowing device of the dish washing machine in accordance with an embodiment of the disclosure.
Figure 14:
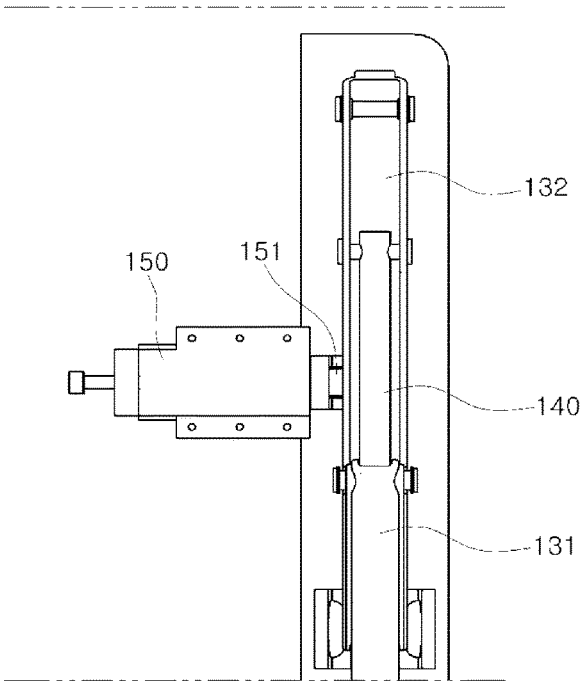

FIG. 13 is a plan view illustrating the inside of the door of the dish washing machine in accordance with an embodiment of the disclosure. FIG. 14 is a view illustrating an operation of the slowing device of the dish washing machine in accordance with an embodiment of the disclosure.

Hereinafter, operations of the slowing device 150 and the rotation stopper 160 in the dish washing machine in accordance with an embodiment of the disclosure will be described.

In the embodiment, the slowing device 150 may be disposed to allow a longitudinal direction of the slowing device 150 to be on a line extending in a longitudinal direction of the link member 130. That is, the slowing device 150 may be disposed to allow the operating body 151 to move backward due to the rotation stopper 160 of the link member 131 when the guide rail 100 moves upward.

As shown in FIGS. 8 and 10, the rotation stopper 160 and the operating body 151 may have a certain distance therebetween when the guide rail 100 is in a lowered state. In other words, when the link members 131 and 132 are arranged parallel to the door 11, the rotation stopper 160 and the operating body 151 may not be in contact with each other. When the guide rail 100 is lifted and the link members 131 and 132 start rotating, the distance between the rotation stopper 160 and the operating body 151 gradually becomes shorter. As the link members 131 and 132 continue rotating, the rotation stopper 160 and the operating body 151 come into contact with each other, and the rotation stopper 160 pressurizes the operating body 151 in a direction in which the operating body 151 moves backward. Meanwhile, as the damping spring 153 is compressed by a force applied to the operating body 151, the damping spring 153 provides an elastic restoring force, that is, a damping force in a direction for moving the operating body 151 forward. The damping force provided by the operating body 151 is transferred to the rotation stopper 160 in such a way that a rotating speed of the link member 130 becomes reduced. Through these operations, the slowing device 150 reduces a moving-up speed of the guide rail 100 before the guide rail 100 arrives at the highest position. Simultaneously, the operating body 151 of the slowing device 150 comes into contact with the rotation stopper 160, thereby limiting rotation angle of the link member 130.

In the above, an example in which the slowing device 150 reduces the moving-up speed of the guide rail 100 has been described. However, independently from the example described above, the slowing device 150 may also be used for reducing the moving-down speed of the guide rail 100. In this case, contrary to the embodiment in which the operating body 151 of the slowing device 150 moves backward as the guide rail 100 moves upward, a part of the link member 130 may be disposed to move the operating body 151 backward when the guide rail 100 moves downward. In the embodiment, the slowing device 150 may be disposed to allow the longitudinal direction to be perpendicular to the longitudinal direction of the link member 130 to perform such function.

As shown in FIG. 14, when the guide rail 100 is in a raised state, the link member 130 does not come into contact with the slowing device 150. When the guide rail 100 is pushed downward and the link member 130 starts rotating, the distance between the link member 130 and the operating body 151 gradually becomes shorter. As the link member 130 continues rotating, the link member 130 and the operating body 151 come into contact with each other, and the link member 130 moves the operating body 151 backward. Here, since the link member 130 applies a force to the operating body 151 from top to bottom, a direction for transferring the force is changed to move the operating body 151 backward. For this, a portion at which the operating body 151 is in contact with the link member 130 is formed to incline or to be rounded in such a way that the operating body 151 may move backward when the link member 130 applies the force from top to bottom. Through these operations, the slowing device 150 may prevent the guide rail 100 from rapidly moving downward. Since force greater than elastic force of the damping spring 153 is necessary to move the operating body 151 backward, the link member 130 moves the operating body 151 backward, and a rotating speed of the link member 130 is reduced. As the rotating speed of the link member 130 is reduced, the moving-down speed of the guide rail 100 also is reduced.

Figure 15:
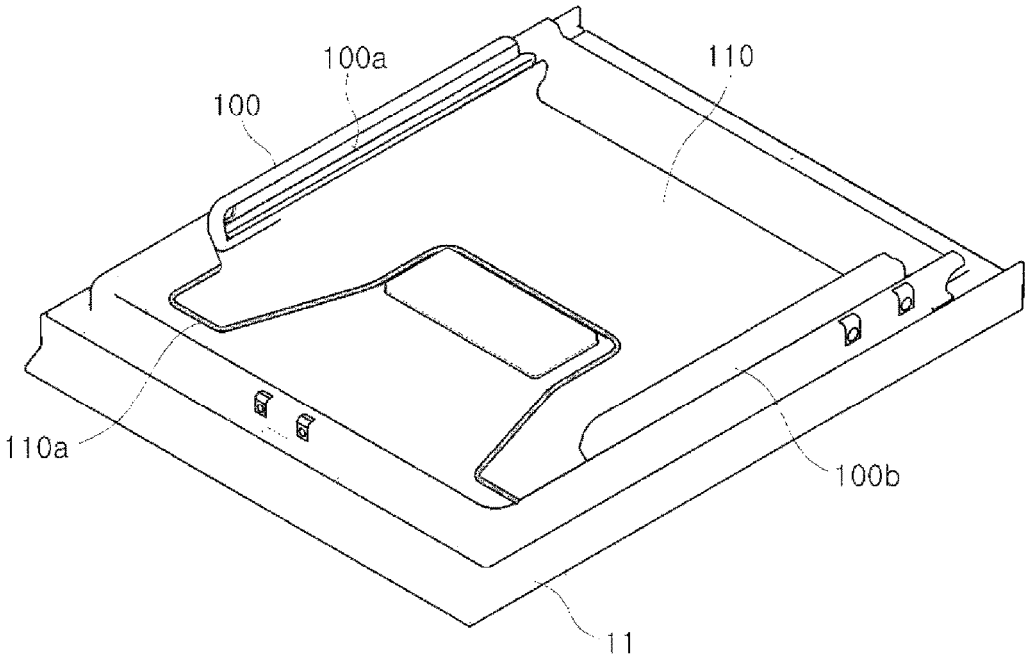
FIG. 15 is a view illustrating the cover member of a dish washing machine in accordance with an embodiment of the disclosure.
Figure 16:
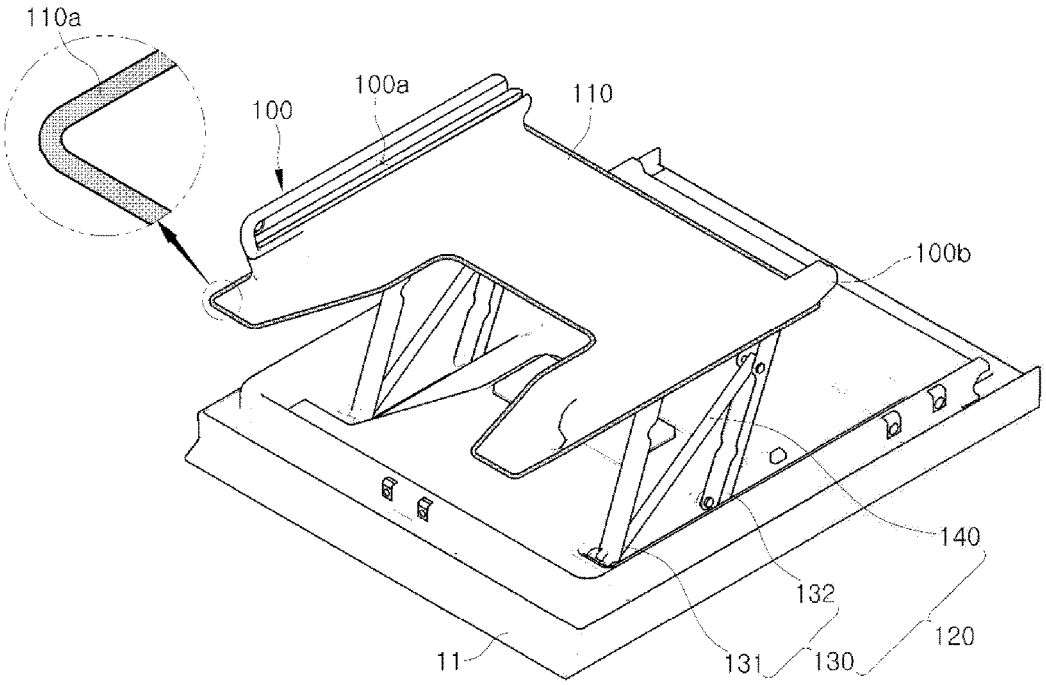
FIG. 16 is a view illustrating a state in which the guide rail moves upward in FIG. 15.

FIG. 15 is a view illustrating the cover member of a dish washing machine in accordance with an embodiment of the disclosure. FIG. 16 is a view illustrating a state in which the guide rail moves upward in FIG. 15.

As shown in FIGS. 15 and 16, the cover member 110 may include a sealing portion 110*a* on an edge thereof to effectively prevent washing water or garbage from permeating into the lifting device 120.

The sealing portion 110*a* is formed at the edge of the cover member 110 and seals a space between the cover member 110 and the rear surface of the door 11. Through this sealing structure, when the dish washing machine operates or the guide rail 100 is in a lowered state, the link member 130, permeation of washing water into the link connecting member 140, etc may be prevented, and, accordingly, the lifting device may be prevented from being contaminated or damaged by washing water and garbage.

Figure 17:
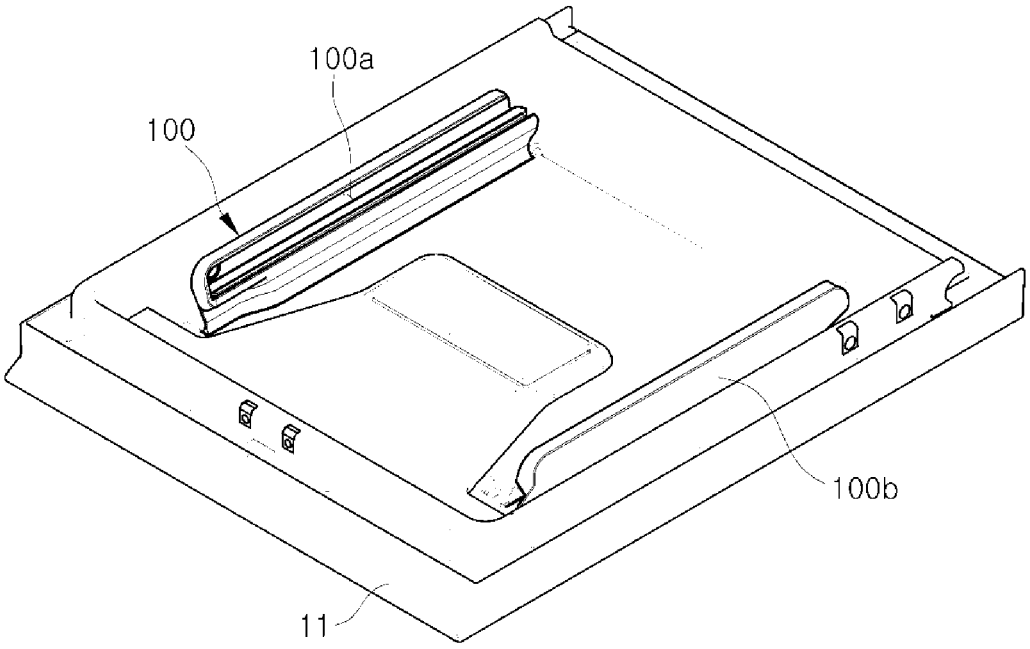
FIG. 17 is a view of the door of the dish washing machine in accordance with an embodiment of the disclosure.
Figure 18:
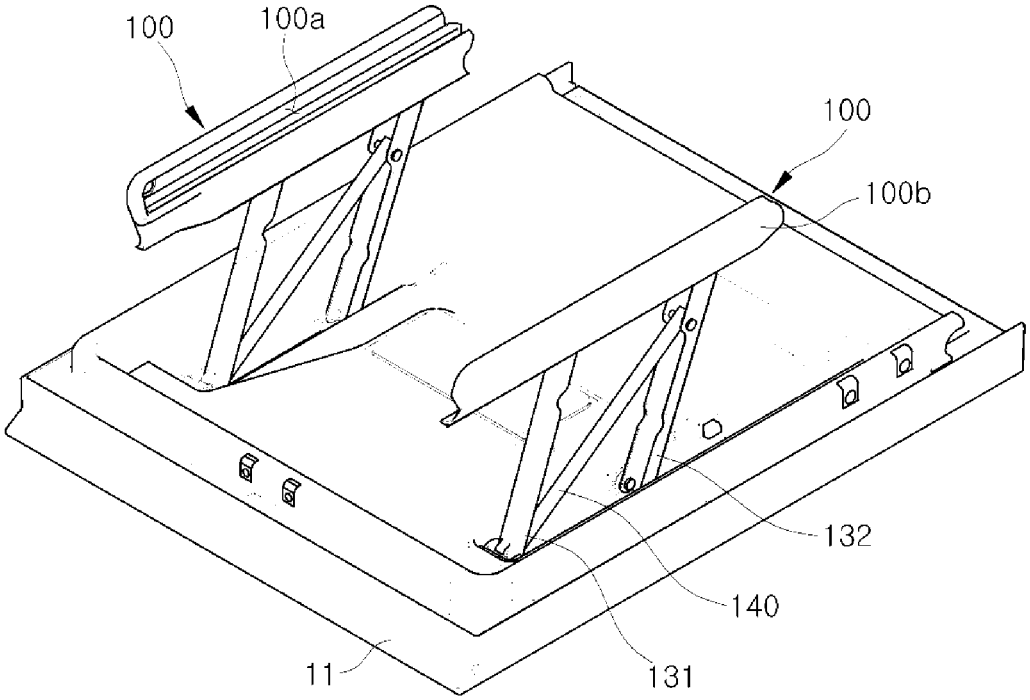
FIG. 18 is a view illustrating a state in which the guide rail of the door moves upward in the dish washing machine of FIG. 17.

FIG. 17 is a view of the door of the dish washing machine in accordance with an embodiment of the disclosure. FIG. 18 is a view illustrating a state in which the guide rail of the door moves upward in the dish washing machine of FIG. 17.

As shown in FIGS. 17 and 18, the pair of guide rails 100 may be provided, and the cover member may not be provided between the pair of guide rails 100. That is, the pair of guide rails 100 may be installed separately from each other.

Each of the guide rails 100 may be supported by the link members and may move upward or downward as the first link member 131 and the second link member 132 pivot. Since a detailed configuration of the lifting device is identical to that shown in FIGS. 5 to 7, a repeated description will be omitted.

In the embodiment shown in FIGS. 17 and 18, a dish washing machine with a simplified structure, reduced number of materials, and reduced manufacturing cost may be provided by omitting the cover member.

Figure 19:
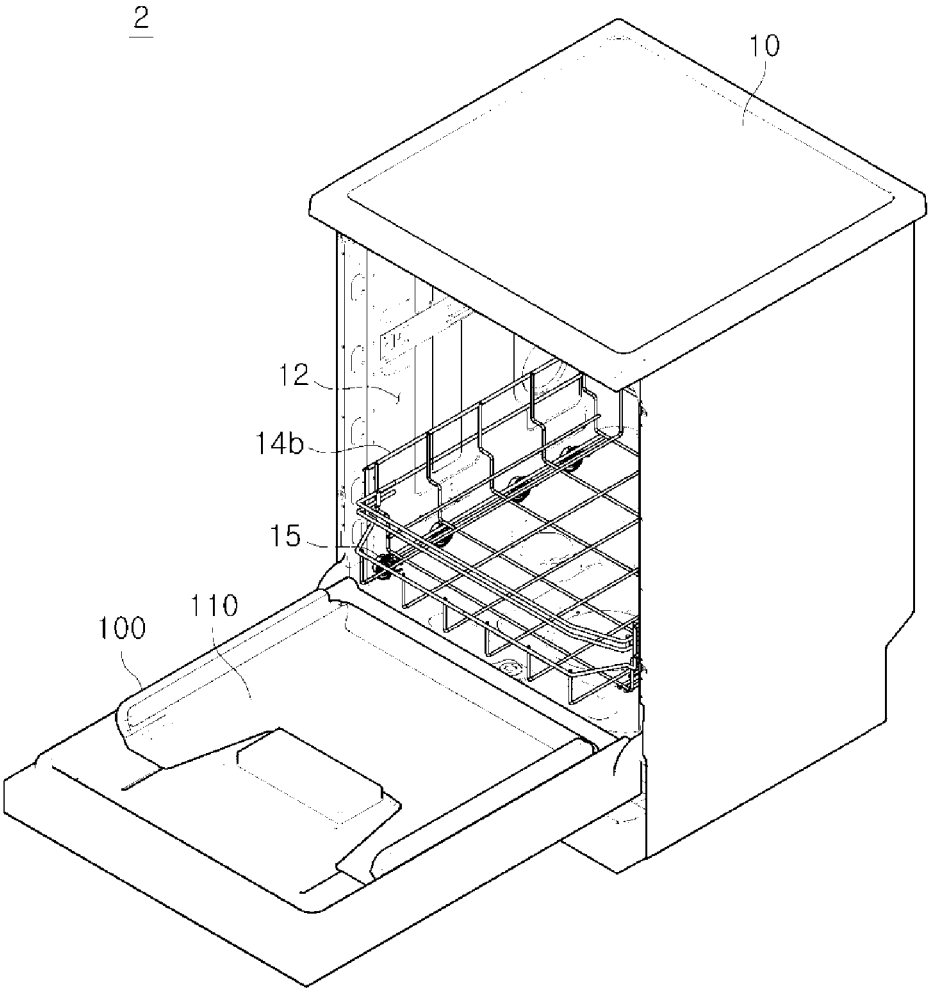
FIG. 19 is a view illustrating a state in which the door of a dish washing machine is open in accordance with an embodiment of the disclosure.
Figure 20:
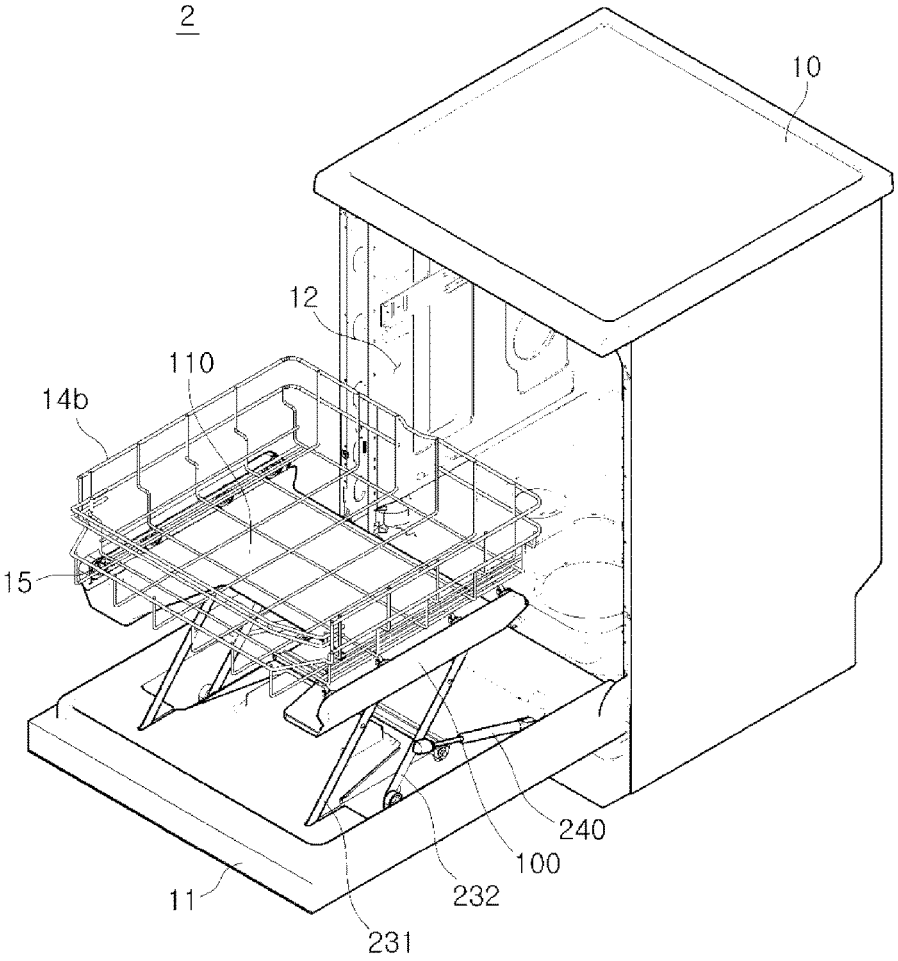
FIG. 20 is a view illustrating a state in which the guide rail of the dish washing machine of FIG. 19 is moved upward.
Figure 21:
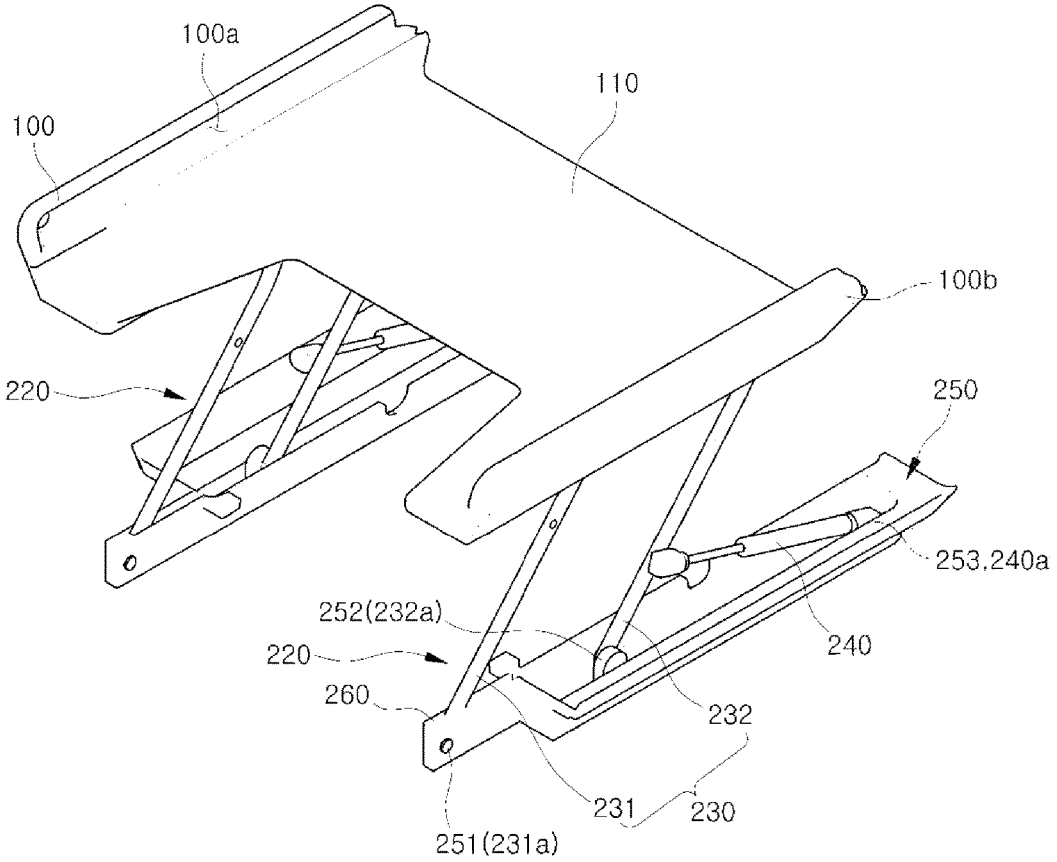
FIG. 21 is a view illustrating the guide rail and a lifting device of the dish washing machine of FIG. 19.

FIG. 19 is a view illustrating a state in which the door of a dish washing machine according to an embodiment of the disclosure is open. FIG. 20 is a view illustrating a state in which the guide rail of the dish washing machine of FIG. 19 is moved upward. FIG. 21 is a view illustrating the guide rail and a lifting device of the dish washing machine of FIG. 19. As shown in FIGS. 19 and 21, a dish washing machine 2 may include the body 10 with an open front, the washing tub 12 provided in the body 10, the basket 14*b* provided in the washing tub 12 to store dishes, and the door 11 which opens and closes the open front of the body 10.

The door 11 may be configured to be pivotable about a rotating shaft provided at the bottom. A user may open the door 11 by pulling a handle (not shown) provided on the outside of the door 11. The door 11 may become opened while the top swings downward.

The door 11 may include at least one guide rail 100 which allows the basket 14*b* to be mounted on a rear surface of the door 11 when the basket 14*b* is drawn out from the washing tub 12 while the door 11 is open and a lifting device 220 which lifts the basket 14*b* mounted on the rear surface of the door 11 using the guide rail 100.

The lifting device 220 may include a link member 230 which supports the guide rail 100 when the guide rail 100 is spaced apart from the rear surface of the door 11, a damper 240, and a lifting device case 250 which accommodates the link member 230 and the damper 240.

A pair of such link members 230 may be provided at one guide rail 100. In this case, the pair of link members 230 may include a first link member 231 and a second link member 232. Each of the link members 231 and 232 may be arranged in a row parallel to each other below the guide rail 100.

Pivoting portions 231*a* and 232*a* may be provided at one end of the link member 230, and the link member 230 may pivot about the pivoting portions 231*a* and 232*a* from the door 11 in such a way that the guide rail 100 may move upward or downward. When the basket 14*b* is mounted on the guide rail 100, the guide rail 100 and the basket 14*b* may move upward or downward together.

When the lifting device 220 is in a lowered state, the lifting device 220 is enclosed inside the door 11 and not exposed outward. That is, when the lifting device 220 is enclosed inside the door 11, the lifting device 220 may be covered by the cover member 110 not to be exposed to outside. Accordingly, when the door 11 is closed, the lifting device 220 may be moved away from a washing space by the cover member 110. Accordingly, the dish washing machine 2 may provide a lifting device having a space separate from a washing tub and a structure with no interference, when the door 11 is closed.

A first pivoting shaft 251 providing a rotation center to allow the first link member 231 to rotate and a second pivoting shaft 252 providing a rotation center to allow the second link member 232 to rotate may be provided at one side of the lifting device case 250. Also, a damper pivoting shaft 253 providing a rotation center to allow the damper 240 to rotate may be provided at another side of the lifting device case 250. In this case, the first pivoting shaft 251 and the second pivoting shaft 252 are arranged corresponding to the pivoting portions 231*a* and 232*a* of the link member 230. Since a damper pivoting portion 240*a* is provided at one end of the damper 240, the damper 240 pivots about the damper pivoting portion 240*a* from the door, and the damper pivoting shaft 253 is disposed corresponding to the damper pivoting portion 240*a*.

The lifting device case 250 may include a rotation stopper 260 at one side thereof which restricts the link member 230 from rotating by a certain angle or more. Limiting the rotation angle of the link member 230 is to limit a maximal raised height of the guide rail 100. This helps the basket 14*b* mounted on the guide rail 100 in moving upward to an optimal height for a user to comfortably and stably load dishes.

As shown in FIG. 21, due to the rotation stopper 260 disposed in front of the first link member 231, the first link member 231 is not allowed to rotate by a certain angle or more. This is because the rotation stopper 260 blocks rotation of the first link member 231 when the first link member 231 comes into contact with the rotation stopper 260. A position and a structure of the rotation stopper 260 are not limited to an example shown in FIG. 21 and may be modified into another structure configured to prevent rotation of a link member. When the guide rail 100 is in a lowered state, the link member 230 and the damper 240 may be arranged in the lifting device case 250.

As shown in FIG. 21, one end of the damper 240 may be connected to be pivotable about the damper pivoting shaft 253 provided at the lifting device case 250, and another end may be pivotably connected to one side of the second link member 232. The damper 240 may be provided to have a variable length. That is, the length of the damper 240 is variable and a force is necessary to increase or decrease the length of the damper 240 due to properties thereof. In other words, the damper 240 is changeable in length, but the length thereof does not rapidly change due to the properties of the damper 240. Due to the properties of the damper 240 described above, unnecessary force may be reduced and a moving-down speed of the guide rail 100 may be reduced when the guide rail 100 is moved upward. The damper 240 may accommodate oil therein. The oil in the damper 240 may prevent a rapid change in the length of the damper 240. Also, a spring (not shown) may be installed in the damper 240. The spring in the damper 240 may be configured to accumulate elastic force when the length of the damper 240 becomes shorter and to apply elastic restoring force in a direction in which the length of the damper 240 becomes longer.

When the guide rail 100 is in a lowered state, the damper 240 may be disposed parallel to a longitudinal direction of the door 11, that is, a direction in which the rollers 15 of the basket 14*b* move and be enclosed. Here, the length of the damper 240 may be small. As the guide rail 100 starts moving upward, the link member 230 pivots about the pivoting portions 231*a* and 232*a*, and the damper 240 connected to a pivoting member becomes longer. As the damper 240 becomes longer, the damper 240 may apply pushing force to the link member 230 and accordingly force necessary for lifting the guide rail 100 may be reduced. On the contrary, when the user tries to lift the guide rail 100 too rapidly, the damper 240 applies pulling force to the link member 230 due to properties thereof. Accordingly, in this case, the guide rail 100 may be prevented from rapidly moving up.

The damper 240 may be in a state in which the length thereof becomes longer when the guide rail 100 is in a raised state. As the guide rail 100 starts moving downward, the link member 230 pivots about the pivoting portions 231*a* and 232*a* and the damper 240 connected to the link member 230 becomes shorter. Here, the damper 240 withstands weight of the basket 14*b* including dishes and reduces moving-down speed of the guide rail 100. That is, the damper 240 supports weight of the guide rail 100 on which the basket 14*b* is mounted. Through this, the user is able to lift the basket 14*b* without exerting a great force, and also the lifting device 220 may be smoothly and stably driven even when dishes are loaded in the basket 14*b*.

Figure 22:
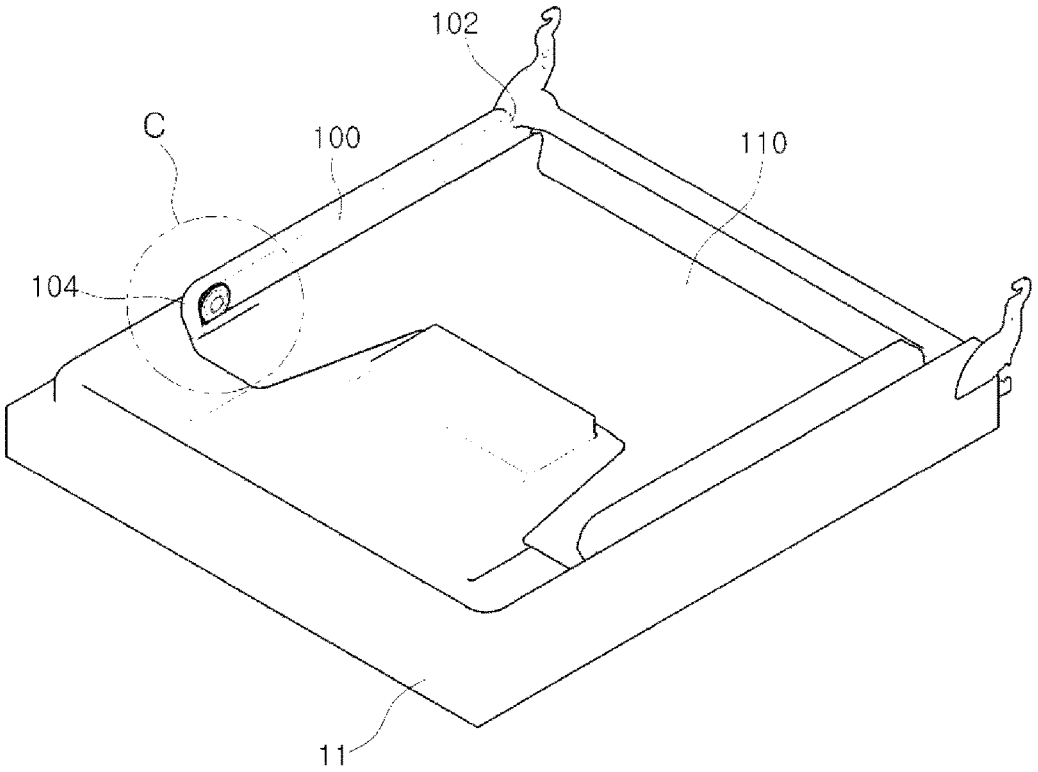
FIG. 22 is a view of the door of the dish washing machine of FIG. 19.
Figure 23:
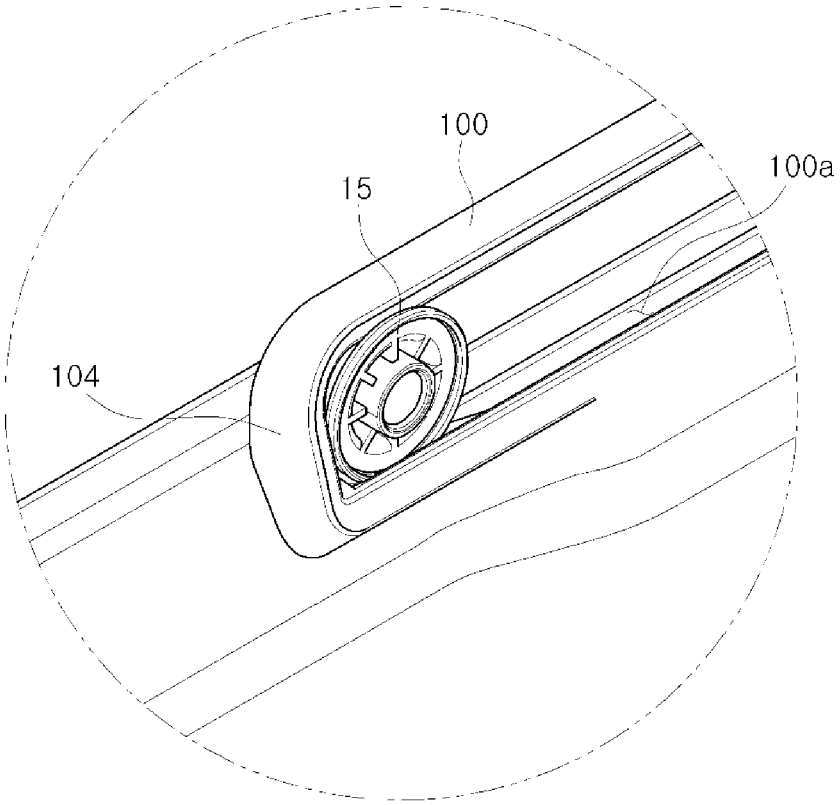
FIG. 23 is an enlarged view illustrating part C of FIG. 22.
Figure 24:
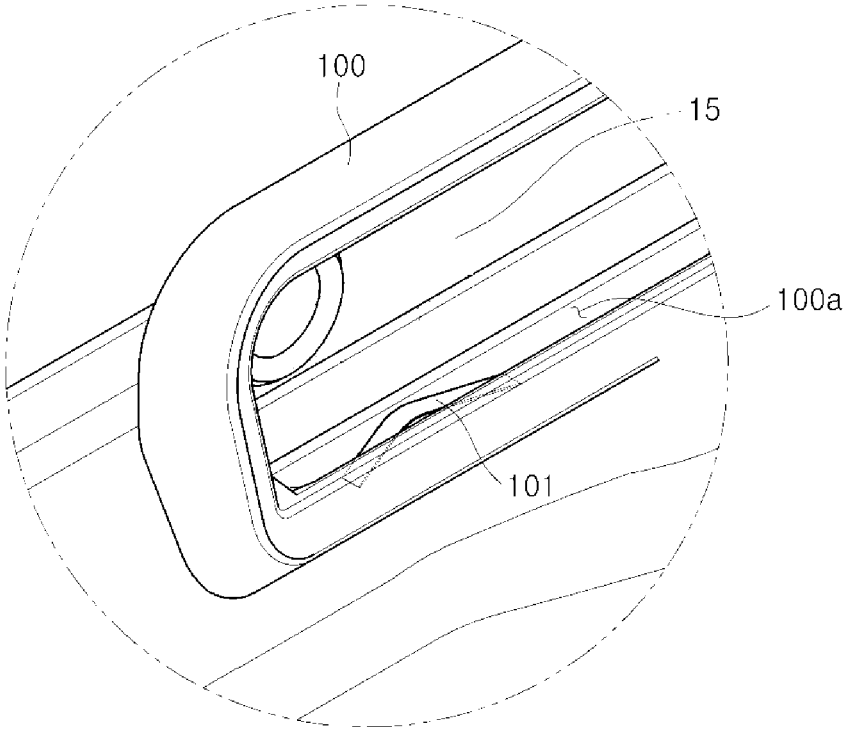
FIG. 24 is an enlarged view of part C of FIG. 22 to transparently show the roller.

FIG. 22 is a view of the door of the dish washing machine of FIG. 19. FIG. 23 is an enlarged view illustrating part C of FIG. 22. FIG. 24 is an enlarged view of part C of FIG. 22 to transparently show the roller.

The basket 14*b* may include a plurality of such rollers 15 at the bottom thereof. The basket 14*b* may smoothly move into or out of the washing tub 12 due to the rollers 15.

The guide rail 100 may be formed in a shape corresponding to the rollers 15 to allow the rollers 15 to be inserted and guided. As shown in FIG. 22, the guide rail 100 may include an open one end 102 and another closed end 104. The rollers 15 may be inserted through the open one end 102 of the guide rail 100 and may move toward the other closed end 104.

The guide rail 100 may include a roller stopper 101 provided to fix the rollers 15 when the rollers 15 are inserted to be close to the other closed end. The roller stopper 101 may be provided at the other closed end of the guide rail 100. The roller stopper 101 may be provided in a holding protrusion shape.

As a modified structure of the rollers 15 and the guide rail 100, as shown in FIGS. 25 and 26, an outer circumferential surface of the roller 25 is caved in toward the rotation center of the roller 25 and the guide rail 200 is formed in a protruding rib shape not to allow the roller 25 to lean left or right while the roller 25 is rolling.

The roller 25 may include a depressed portion 25*a* which is a center of an outer circumferential surface thereof and depressed toward the rotation center of the roller 25 and a protruding portion 25*b* which is both sides of the depressed portion 25*a* and forms the outer circumferential surface of the roller 25.

The guide rail 200 may include a rail protruding portion 200*a* which protrudes corresponding to the depressed portion 25*a* of the roller 25 and a rail bottom portion 200*b* which is formed on both sides of the rail protruding portion 200*a* and is in contact with the protruding portion 25*b* of the roller 25.

The rail protruding portion 200*a* may be inserted in the depressed portion 25*a* of the roller 25, and the roller 25 may be guided along the rail protruding portion 200*a*. Through this, without forming a guide wall, the roller 25 may not lean left or right.

As is apparent from the above description, a dish washing machine in accordance with one or more embodiments of the disclosure may increase convenience for a user when loading dishes in or unloading dishes from a lower basket.

A dish washing machine in accordance with one or more embodiments of the disclosure may reduce a space occupied by a lifting device, thus not reducing washing space. Also, a dish washing machine in accordance with one or more embodiments of the disclosure may reduce a garbage blocking phenomenon which occurs during washing or draining.

A dish washing machine in accordance with one or more embodiments of the disclosure may include a lifting device for moving a lower basket up and down using a small force.

Although example embodiments of the disclosure have been shown and described, it would be appreciated by those skilled in the art that changes may be made to these embodiments without departing from the principles and spirit of the disclosure, the scope of which is defined in the claims and their equivalents.

What is claimed is:

1. A dish washing machine, comprising:

a washing tub with an open front;

a basket configured to be inserted into or drawn out from the washing tub through the open front of the washing tub;

a door configured to open or close the open front of the washing tub;

at least one guide rail configured to mount the basket on the door when the basket is drawn out from the washing tub while the door is open; and a lifting device configured to raise and lower the at least one guide rail between a raised position and a lowered position, respectively, the lifting device including:

first and second link members pivotably provided at the door, the first link member having a first inner space which faces a second inner space of the second link member, and a link connecting member connecting the first and second link members, the link connecting member being disposed in the first inner space and the second inner space when the at least one guide rail is in the lowered position.

2. The dish washing machine of 1, wherein the lifting device is enclosed inside the door when the at least one guide rail is in the lowered position and is exposed outside the door when the at least one guide rail is in the raised position.

3. The dish washing machine of claim 1, wherein one end of the link connecting member is pivotably coupled with the first link member and another end of the link connecting member is pivotably coupled with the second link member, and the link connecting member has a same rotation shaft as the first link member.

4. The dish washing machine of claim 1 wherein the first and second link members are arranged to at least partially overlap each other when the at least one guide rail is in the lowered position.

5. The dish washing machine of claim 1, wherein
the link connecting member, the first link member, and the second link member are aligned along a same axis when the at least one guide rail is in the lowered position.

6. The dish washing machine of claim 1, wherein the link connecting member includes at least one elastic member configured to provide an elastic restoring force in a direction in which the at least one guide rail moves upward.

7. The dish washing machine of claim 6, wherein
the at least one elastic member is a spring.

8. The dish washing machine of claim 1, wherein the door further includes at least one slowing device configured to reduce at least one of a speed at which the at least one guide rail is raised and a speed at which the at least one guide rail is lowered.

9. The dish washing machine of claim 1, wherein at least one of the first and second link members includes a rotation stopper configured to limit a rotation angle of the at least one of the first and second link members.

10. The dish washing machine of claim 1, wherein
the basket includes a plurality of rollers at a bottom thereof, and
the at least one guide rail includes a rail groove on which the plurality of rollers are mounted.

11. The dish washing machine of claim 10, wherein the at least one guide rail further includes a roller stopper configured to limit a movement of the plurality of rollers.

12. The dish washing machine of claim 1, wherein the at least one guide rail includes a pair of guide rails arranged parallel to one another.

13. The dish washing machine of claim 1, further comprising a cover member configured to cover the lifting device when the at least one guide rail is in the lowered position.

14. A dish washing machine, comprising:
a washing tub with an open front;
a basket configured to be inserted into or drawn out from the washing tub through the open front of the washing tub;
a door configured to open or close the open front of the washing tub;
at least one guide rail configured to mount the basket on the door when the basket is drawn out from the washing tub while the door is open; and
a lifting device configured to raise and lower the at least one guide rail between a raised position and a lowered position, respectively,
wherein
the door further includes at least one slowing device configured to reduce at least one of a speed at which the at least one guide rail is raised and a speed at which the at least one guide rail is lowered, and
the slowing device includes an operating body configured to reciprocate and to apply a force to the lifting device and a damping spring which provides an elastic restoring force to the operating body.

15. A dish washing machine, comprising:
a washing tub with an open front;
a basket configured to be inserted into or drawn out from the washing tub through the open front of the washing tub;
a door configured to open or close the open front of the washing tub;
at least one guide rail configured to mount the basket on the door when the basket is drawn out from the washing tub while the door is open;
a lifting device configured to raise and lower the at least one guide rail between a raised position and a lowered position, respectively; and
a cover member configured to cover the lifting device when the at least one guide rail is in the lowered position, the cover member including a sealing portion configured to prevent washing water from permeating the lifting device when the cover member covers the lifting device.

16. A dish washing machine, comprising:
a washing tub having an open portion;
a basket; and
a door configured to open or close the open portion of the washing tub, the door including:
at least one guide rail disposed on a rear surface of the door and configured to guide the basket when the basket is drawn out from the washing tub, and
a lifting device, configured to raise the at least one guide rail to a raised position and to lower the at least one guide rail to a lowered position, the lifting device being disposed between a front surface and the rear surface of the door when the at least one guide rail is in the lowered position, the lifting device including:
first and second link members pivotably provided at the door, the first link member having a first rotation center provided at an upper portion of the door relative to a second rotation center of the second link member, and
a damper, connected at one end to the second link member and connected at another end to the door, having a third rotation center provided at a lower portion of the door relative to the second rotation center of the second link member, the damper being configured to provide a damping force in a direction for reducing a movement speed of the at least one guide rail.

17. The dish washing machine of claim 16, wherein the lifting device further includes a lifting device case to accommodate the first and second linking members and the damper.

18. The dish washing machine of claim 17, wherein the lifting device case includes:
a first pivoting shaft that provides the first rotation center to allow the first link member to rotate,
a second pivoting shaft to provide the second rotation center to allow the second link member to rotate, and
a damper pivoting shaft to provide the third rotation center to allow the damper to rotate.

19. The dish washing machine of claim 16, wherein at least a portion of the rear surface of the door includes a cover member configured to cover the lifting device when the at least one guide rail is in the lowered position.

20. The dish washing machine of claim 16, wherein the damper is variable in length according to a position of the at least one guide rail.

* * * * *